US005582950A

United States Patent [19]

Katagiri et al.

[11] Patent Number: 5,582,950

[45] Date of Patent: Dec. 10, 1996

[54] PROCESS FOR PRODUCING FLASH FUSING COLOR TONER

[75] Inventors: Yoshimichi Katagiri; Kazuyuki Kishimoto; Kazuhiko Kido; Yasufumi Nakamura, all of Kawasaki; Hidenori Fujioka, Kato-gun; Masahiro Nishihata; Kazuya Hamada, both of Kawasaki; Masakazu Kinoshita; Hitoshi Kusaba, both of Kato-gun; Ikuya Yamabata, Kawasaki; Tetsuro Baba, Kawasaki; Haruo Kuroda, Kawasaki; Yuzo Horikoshi, Kawasaki; Masaki Nagaoka, Kawasaki; Yumi Fujisaki, Kawasaki; Yuko Ohyama, Kawasaki; Eiji Sakurai, Kawasaki, all of Japan

[73] Assignee: Fujitsu Limited, Tokyo, Japan

[21] Appl. No.: 423,635

[22] Filed: Apr. 17, 1995

Related U.S. Application Data

[62] Division of Ser. No. 165,508, Dec. 13, 1993, Pat. No. 5,432,035.

[30] Foreign Application Priority Data

| | | | |
|---|---|---|---|
| Dec. 18, 1992 | [JP] | Japan | 4-338597 |
| Sep. 20, 1993 | [JP] | Japan | 5-233891 |

[51] Int. Cl.[6] ..... G03G 9/097; G03G 9/09

[52] U.S. Cl. ..... 430/137

[58] Field of Search ..... 430/106, 110, 430/137

[56] References Cited

U.S. PATENT DOCUMENTS

| | | | |
|---|---|---|---|
| 2,297,691 | 4/1939 | Carlson | 430/31 |
| 4,699,863 | 10/1987 | Sawatari et al. | 430/97 |
| 5,362,592 | 11/1994 | Murofushi et al. | 430/110 X |

FOREIGN PATENT DOCUMENTS

| | | |
|---|---|---|
| 43-25335 | 11/1968 | Japan . |
| 52-32328 | 3/1977 | Japan . |
| 60-57858 | 4/1985 | Japan . |
| 60-63545 | 4/1985 | Japan . |
| 60-63546 | 4/1985 | Japan . |
| 60-230667 | 11/1985 | Japan . |
| 61-132959 | 6/1986 | Japan . |
| 63-161460 | 7/1988 | Japan . |

*Primary Examiner*—Roland Martin

*Attorney, Agent, or Firm*—Armstrong, Westerman, Hattori, McLeland & Naughton

[57] ABSTRACT

A process for producing a wherein an aminium salt infrared light absorber and a positive charge control agent are used in combination while preventing a mutual reaction therebetween. In this toner, the physical contact of the aminium salt compound with the positive charge control agent is avoided (e.g., by separately adding them to respective two separated phases of a binder resin), or alternatively use is made of such a combination of confounds as will not cause a mutual reaction (e.g., a common anion is used).

3 Claims, 1 Drawing Sheet

PROCESS FOR PRODUCING FLASH FUSING COLOR TONER

This is a division of application Ser. No. 08/165,508, filed Dec. 13, 1993, now U.S. Pat. No. 5,432,035.

BACKGROUND OF THE INVENTION

1. Field of the Invention

The present invention relates to a flash-fixing color toner for use in the development of an electrostatic latent image in electrophotography and the like and a process for producing the same. More particularly, the present invention is concerned with a flash-fixing color toner which comprises as an indispensable ingredient a near-infrared light absorber composed mainly of an aminium salt compound which allows the triboelectric property of a toner to be regulated, and a process for producing the same.

2. Description of the Related Art

Electrophotography known in the art includes a system described in U.S. Pat. No. 2,297,691 and the like. In this system, a photoconductor (a photoconductive drum or the like) is generally used, an even electrostatic charge is provided on the surface of the photoconductor by corona discharge or the like, and an optical image is applied onto the photoconductor by various means to form an electrostatic latent image that is then developed with a fine powder called a "toner".

If necessary, the toner image is transferred onto a recording medium, such as paper. The toner image is then melted by means of pressing, heating, solvent vapor, light or the like to fix the toner image to the recording medium, thereby providing a print.

Particles formed by pulverizing a dispersion comprising a binder resin comprised of a naturally occurring or synthetic polymeric material and, dispersed in the binder resin, a coloring material and optionally additives, such as a charge control agent, to a size of about 1 to 30 μm have hitherto been used as the toner for developing the electrostatic latent image.

In an electrophotographic two-component development process, the above-described toner is usually mixed with a carrying material (a carrier) including a ferromagnetic material, such as an iron powder, or a glass bead, before use in the development of the electrostatic latent image. In the case of a magnetic brush development process using as the carrier ferromagnetic particles, such as an iron powder or ferrite, the development is effected by mixing and stirring a developer comprising a toner and a carrier in a developing unit to effect triboelectrification, holding the triboelectrified toner with a magnetic roll in the developing unit to form a magnetic brush that is then transferred to a latent image portion on a photoconductor where charged toner particles alone are adhered to the latent image by electric attraction.

In this case, a polymer resin generally called an "oligomer", having a low molecular weight to exhibit a low melting viscosity, is extensively used as the binder resin, because the binder resin constituting the toner should be rapidly fused and exhibit a good fixation in the stage of the fixing of the toner to a recording medium.

In the above-described fixation, the toner on recording paper is fused by means of pressing, heating, exposing solvent vapor, irradiating light, etc. and then anchored to the recording paper. Among these fixing methods, the photo-fixing method has attracted attention because it has the following features.

(1) No deterioration of the resolution of the image in the stage of the fixing occurs by virtue of non-contact fixation.

(2) Quick start is possible because there is no need for waiting time after turning on the power.

(3) Even though a system failure may give rise to a recording paper jam within a fixing unit, there is no danger of the recording paper being ignited.

(4) The fixing can be successfully effected independently of the material and thickness of the recording paper even when use is made of glued paper (tack paper), preprint paper and various kinds of paper different from each other in the thickness.

The current most common photo-fixing method is a flash fixing method using a xenon flash lamp as a light source.

In a photo-fixing method that uses a light source having a high luminous intensity at wavelengths in an infrared region, such as the xenon flash fixing method, the addition of an infrared light absorber, such as an aminium salt compound, in a toner has been proposed in Japanese Unexamined Patent (Kokai) No. 61-132959 for the purpose of improving the light absorption capability of the toner and expanding the range of utilization of the photo-fixing method having the above-described advantages.

Many of compounds having a high infrared absorption capability have hues ranging from brown to black. The aminium salt compounds, however, exhibit an excellent infrared absorption capability and, at the same time, have a light color tone in a visible light region, so that the toner, as such, is less likely to have an influence on the color tone of the toner, which renders these compounds very useful for making up for the light absorption capability of the color toner.

Since, however, the aminium salt compounds are substances having a salt structure having a counter ion as represented by the following formulae:

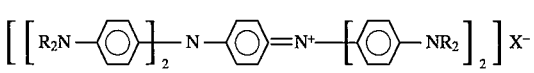

(1)

wherein $X^-$ is an arbitrary anion with an arbitrary valency; and

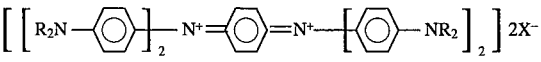

(2)

wherein $X^-$ is an arbitrary anion with an arbitrary valency, when a high polar site (for example, a substance which have a tertiary amine group, such as dimethylaminoethyl methacrylate) and a high reactive ionic compound (for example, a quaternary ammonium salt) are present in the toner, the counter ions of the aminium salt compounds are extracted by the polar group or give rise to a counter ion exchange reaction with the ionic compound.

This causes a structural change of the aminium salt compound, which results in a shift in the light absorption band of the aminium salt compound and, in extreme cases, a complete loss of the capability of absorbing light having wavelengths in a flash light region.

On the other hand, the quaternary ammonium salt has an excellent charge control capability as a colorless positive charge control agent and is commonly used in color toners. The addition of an amine compound other than the quaternary ammonium salt to the toner, the introduction of an amine functional group into the binder resin, or other means, is used as a method for imparting a positive chargeability to the toner without use of the quaternary ammonium salt. As described above, however, the amine compound too has a high possibility of causing a structural change to the aminium salt compound.

For the reasons set out above, the aminium salt compound for improving the light absorption capability cannot be used in combination with the amine compound for imparting a charge control capability (hereinafter referred to as a "charge control agent"), such as a quaternary ammonium salt, and there is a problem that a positive charge color toner having an excellent light absorption capability and a good photo-fixability is poor in the chargeability, while the positive charge color toner having an excellent chargeability is poor in photo-fixability.

The present invention has been made in view of the above-described problems of the prior art, and an object of the present invention is to provide a flash fixing toner that enables the structural change of the aminium salt compound to be minimized while the aminium salt compound and a charge control agent coexist in a toner, thereby attaining a combination of an excellent flash fixability with an excellent chargeability, and a process for producing the same.

SUMMARY OF THE INVENTION

In order to attain the above-described object, the present invention provides a flash fixing color toner comprising a binder resin, an infrared light absorber comprising an aminium salt compound represented by the following general formula (1) and/or general formula (2)

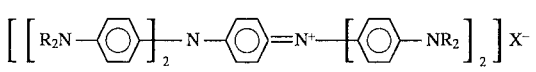

(1)

wherein $X^-$ is an arbitrary anion with an arbitrary valency, and

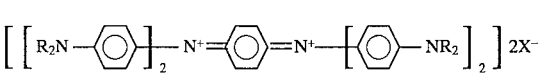

(2)

wherein $X^-$ is an arbitrary anion with an arbitrary valency, a coloring material and a positive charge control agent, in which a reaction of said infrared light absorber with said positive charge control agent or/and positive charge control resin (the positive charge control agent and positive charge control resin being also collectively referred to simply to as a "positive charge control agent") is prevented by any of the following means (i) to (vi) or alternatively the light absorption capability and charge control capability deteriorated by the reaction of the infrared light absorber with the positive charge control agent are compensated for by the following means (vii) or (viii):

(i) means where a mixture of a plurality of resins is used as the binder resin and the infrared light absorber is selectively dispersed or dissolved in a particular resin constituting a part of the plurality of resins, (ii) means where a positive charge control agent and/or a binder resin containing a positive charge control agent are coated on or deposited in a fine particle form on the outer periphery of a toner comprising an infrared light absorber, a coloring material and a binder resin, (iii) means where an infrared light absorber and/or a binder resin containing an infrared light absorber are coated on or deposited in a fine particle form on the outer periphery of a toner comprising a positive charge control agent, a coloring material and a binder resin, (iv) means where a mixture of an amine-functional-group-containing resin, which contains a secondary amine and/or a tertiary amine and/or a quaternary amine and/or a quaternary ammonium salt, and a resin containing an acidic functional group is used as the binder resin to block the amine-functional-group-containing resin and/or the quaternary ammonium salt with the resin containing an acidic functional group, (v) means where at least one member selected from the group consisting of a thermoplastic resin having an amide group and/or a pendant group of a nitrogen-containing ring, an amide compound, a polyamide resin, an amine-modified polyester resin, a urethane-modified polyester resin and an amine-modified epoxy resin crosslinked with a diamine is used as the binder resin, (vi) means where a quaternary ammonium salt represented by the following general formula (3) is used as the positive charge control agent:

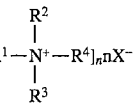

(3)

wherein $R^1$ to $R^4$ each represent an arbitrary alkyl group, a phenyl group or a derivative thereof and $X^-$ represents the same anion as that defined in the general formulae (1) and (2), (vii) means where the infrared light absorber is composed of either a compound represented by the general formula (1) in combination with a compound represented by the general formula (2) with an anion $X^-$ common to both the compounds or at least two compounds represented by the general formula (1), (viii) means where at least one of compounds represented by the general formulae (4) to (8) is additionally used as a component of the infrared light absorber:

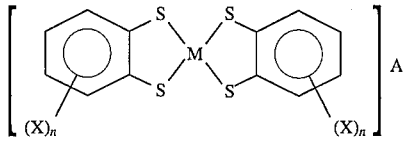

(4)

wherein

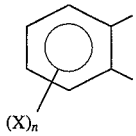

represents an aromatic ring having a skeleton represented by

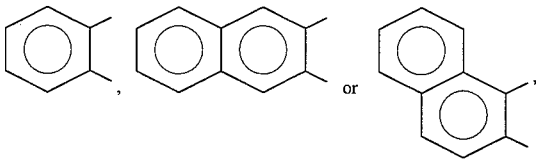

X represents hydrogen, a halogen, an alkyl or a halogenated alkyl, S represents sulfur, M represents nickel, cobalt, platinum or palladium and A represents a quaternary ammonium salt,

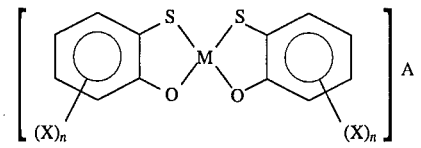

(5)

wherein

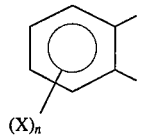

represents an aromatic ring having a skeleton represented by

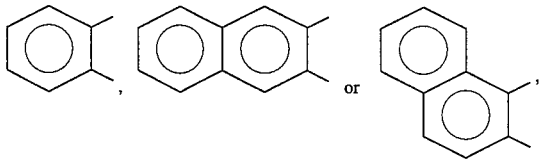

X represents hydrogen, a halogen, an alkyl or a halogenated alkyl, S represents sulfur, O represents oxygen, M represents nickel, cobalt, platinum or palladium and A represents a quaternary ammonium salt,

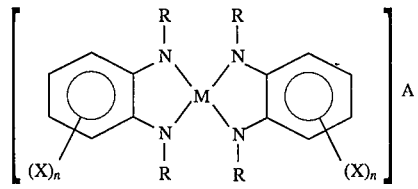

(6)

wherein

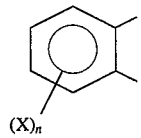

represents an aromatic ring having a skeleton represented by

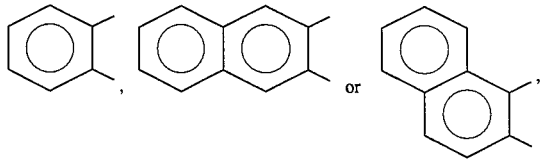

X represents hydrogen, a halogen, an alkyl or a halogenated alkyl, R represents hydrogen, an alkyl or a halogenated alkyl, N represents nitrogen, M represents nickel, cobalt, platinum or palladium and A represents a quaternary ammonium salt,

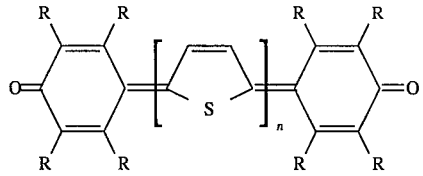

(7)

wherein R represents hydrogen, an alkyl or a halogenated alkyl having 1 to 4 carbon atoms, O represents oxygen, S represents sulfur and n is a positive integer, and

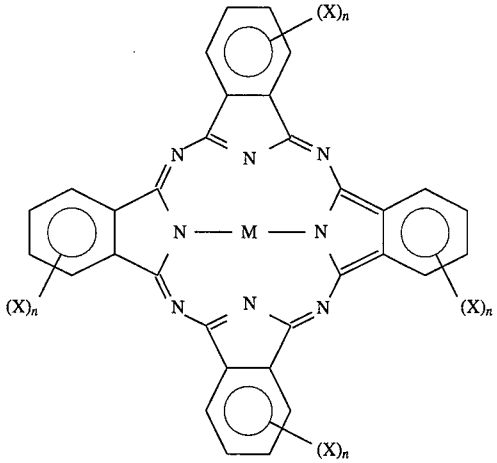

(8)

wherein

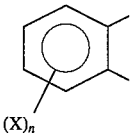

represents an aromatic ring having a skeleton represented by

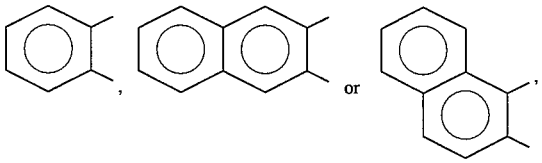

X represents hydrogen, a halogen, an alkyl or a halogenated alkyl, N represents nitrogen, M represents a divalent metal atom, a tri- or tetravalent substituted metal atom or two hydrogen atoms.

DESCRIPTION OF THE PREFERRED EMBODIMENTS

Figure 1:
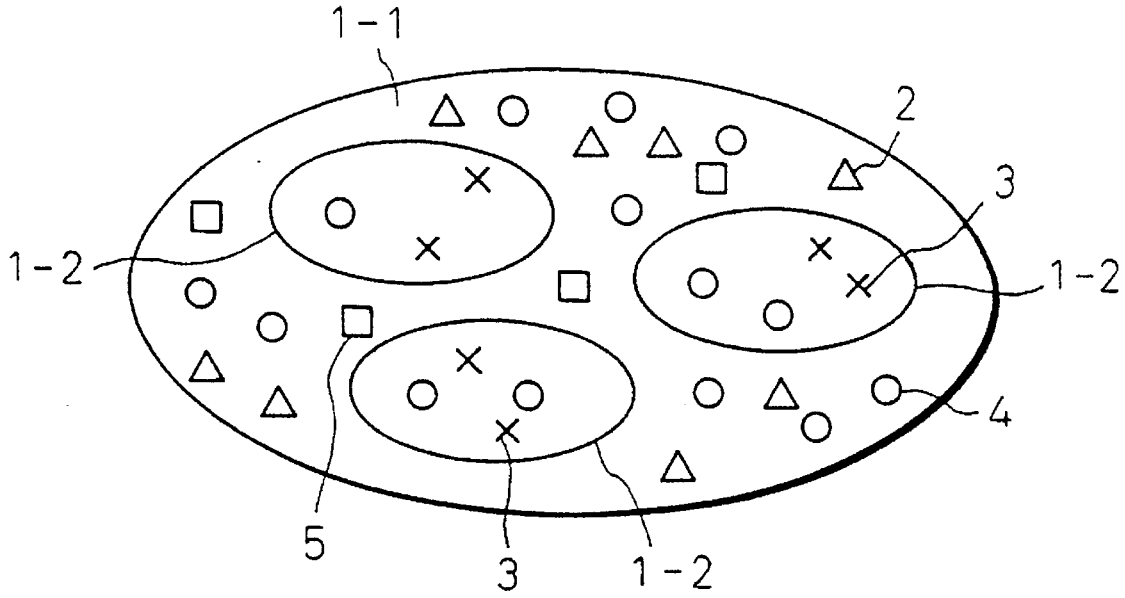
FIG. 1 is a schematic diagram showing a construction of a toner using means (i) according to an embodiment of the present invention.

The present invention will now be described in more detail.

The toner of the present invention is a flash fixing color toner that comprises a binder resin and, incorporated therein, a coloring material, an infrared light absorber and a positive charge control agent.

The binder resin is not particularly limited, and various thermoplastic resins comprising naturally occurring or synthetic polymeric materials may be used as the binder resin. Representative examples of the binder resin include an epoxy resin, a styrene-acrylic resin, a polyamide resin, a polyester resin, a polyvinyl resin, a polyurethane resin and a polybutadiene resin, and mixtures thereof having average molecular weights in the range of from about 5,000 to 100,000 and melting points in the range of from 90° to 140° C.

The coloring material (colorant) also is not particularly limited, and use may be made of any dye or pigment. Examples of the coloring material include quinacridone (red), phthalocyanine (blue or the like), anthraqninone (red), bisazo (red or yellow), monoazo (red), anilide compound (yellow), benzidine (yellow) and halogenated phthalocyanine (green).

Aminium salt compounds represented by the general formulae (1) and (2) are used as the infrared light absorber. These aminium salt compounds have a high capacity for absorbing light having wavelengths in the infrared light region and have a light color tone in the visible light region, so that they are less likely to contaminate the color tone of the toner, which renders the aminium salt compounds suitable for use in color toners. It is also possible to use the aminium salt compounds in combination with infrared light absorbers other than the aminium salt compounds represented by the general formulae (1) and (2). Black dyes and pigments, such as carbon black, have a high infrared light absorption capability. They, however, have a high blackness and contaminate the color tone of the toner, so that they cannot be used in the color toners.

In the general formulae (1) and (2), representative examples of the anion $X^-$ include ions of perchlorate ($CClO_4^-$), fluoroborate ($BF_4^-$), trichloroacetate ($CCl_3COO^-$), trifluoroacetate ($CF_3COO^-$), picrate ($(NO_2)_3C_6H_2O^-$), hexafluoroarsenate ($AsF_6^-$), hexafluoroantimonate ($SbF_6^-$), benzenesulfonate ($C_6H_5SO_3^-$), ethanesulfonate ($C_2H_5SO_3^-$), phosphate ($PO_4^{-2}$), sulfate ($SO_4^-$) and chloride ($Cl^-$).

The positive charge control agent also is not particularly limited so far as it has a capability of imparting a positive charge to the toner when the developer is stirred. Suitable examples thereof include a quaternary ammonium salt (colorless), a nigrosine dye (black), a triphenylmethane derivative (blue). Further, compounds and resins, which will be described later, may also be used as the positive charge control agent. Further, the positive charge control agent may be used in combination with negative charge control agents, such as naphthoic acid-zinc complex (colorless) and salicylic acid-zinc complex (colorless), for the purpose of regulating the charge control capability.

Various other additives may be added to the flash fixing color toner, and examples thereof include particularly waxes (for example, polypropylene wax) and surfactants (for example, silicone varnish).

The average particle diameter of the toner is generally in the range of from about 1 to 30 μm. However, it is not limited to this range.

In the above-described flash fixing color toner, the present invention is characterized in that a lowering or a loss of an infrared absorption capability of the aminium salt infrared light absorber particularly upon being reacted with a positive charge control agent is prevented, suppressed or compensated for by the following means.

Means (i)

As schematically shown in FIG. 1, a mixture of the binder resins 1-1 and 1-2 having a poor compatibility is used as the binder resin, and an aminium salt infrared light absorber 2 is selectively dispersed or dissolved in the particular binder resin 1-1 of the two binder resins. In particular, a positive charge control agent 3 is selectively dispersed or dissolved in the other binder resin 1-2.

The formation of the so-called "islands-sea" structure by a plurality of binder resins 1-1 and 1-2 and the presence of an infrared light absorber 2 selectively in the particular binder resin 1-1 (or 1-2), still preferably the presence of a positive charge control agent 3 in the other binder resin 1-2 (or 1-1), reduces the opportunity of contact of the infrared light absorber 2 with the positive charge control agent 3, which can prevent or suppress the mutual reaction between the infrared light absorber 2 and the positive charge control agent 3. This has enabled the flash fixing color toner to satisfy both the fixability and chargeability requirements.

As described above, the aminium salt compound loses its function when the counter ion is disturbed. The materials which give rise to such a reaction include quaternary ammonium salts and amine-functional-group-containing resins that are used extensively as a charge control agent for a positive charge toner.

Studies conducted by the present inventors have revealed that it is also possible to use a resin (an amine-functional-group-containing resin) having a high chargeability, such as a resin having an amine compound in the molecular structure, as at least one binder in the plurality of binders used in a toner and use this resin as the "sea" or "islands" with the resin maintaining the function as a positive charge control agent.

For example, an amine-functional-group-containing resin in a gel form having a melting point of 200° C. or above may be used as the positive charge control agent.

The reason why the use of the resin in a gel form having a melting point of 200° C. or above is still preferred is that the selection of a resin capable of remaining unsoftened at a general kneading temperature enables the reaction thereof with the aminium salt compound to be suppressed.

The difference in the solubility parameter between the binder resin 1-1 in which the aminium salt compound 2 is dispersed or dissolved and the binder resin 1-2 in which the positive charge control agent 3 is dispersed or dissolved should be 0.5 or more, preferably 1 or more.

This is because when the solubility parameter of each of the binder resins 1-2 and 1-1 is high, both binders are homogeneously mixed with each other without the formation of the "islands-sea structure", which increases the opportunity for the aminium salt compound 2 and the positive charge control agent 3 to opposed each other, so that it becomes difficult to attain the object of the present invention.

Studies conducted by the present inventors have revealed that examples of the combination of thermoplastic resins capable of satisfying these requirements include a combination of a polyester resin with an epoxy resin, a combination of a polyester resin with a styrene-acrylic resin, a combination of a polyester resin with a polyamide resin, a combination of a polyester resin with a styrene-butadiene resin, a combination of an epoxy resin with a styrene-acrylic resin, a combination of an epoxy resin with a polyamide resin, a combination of an epoxy resin with a styrene-butadiene resin, a combination of a polyamide resin with a styrene-acrylic resin, a combination of a polyamide resin with a styrene-butadiene resin, a combination of a styrene-acrylic resin with a styrene-butadiene resin and other various combinations and these combinations can satisfy the above-described solubility parameter difference requirement and, at the same time, can satisfy various property requirements for the flash fusing binder.

According to studies conducted by the present inventors, among the above-described combinations, those capable of providing the best properties are combinations of a polyester resin with a styrene-acrylic resin, a styrene-butadiene resin, copolymer resins of styrene, acrylate and butadiene and other resins.

This is because the use of the combinations of a polyester resin with a styrene-acrylic resin, a styrene-butadiene resin, copolymer resins of styrene, acrylate and butadiene and other resins facilitates the attainment of melt viscoelastic (rheology) properties necessary for preventing a "void phenomenon" caused by the melting and aggregation of toner particles in flash fixing as discussed in Japanese Unexamined Patent Publication (Kokai) No. 4-56869 and, at the same time, maintaining a good fixability.

Further, according to the studies conducted by the present inventors, polyester resins are still preferred as the binder resin for dispersing the aminium salt compound. This is because even the above-described resins not containing an amine compound give rise to a salt-abstracting reaction with the aminium salt compound, although the degree of abstraction of the salt is lower than that in the case of the amine compound depending upon particular monomer constituting the binder resin.

This phenomenon is often observed when the styrene-acrylic resin or the like is used as the binder. For example, studies conducted by the present inventors have revealed that no reaction is observed between a styrene-n-butyl acrylate copolymer and an aminium salt compound, whereas a styrene-2-ethylhexyl acrylate copolymer gives rise to a strong salt-abstracting reaction.

With respect to polyester resins, various binder resins were produced with varied monomer species, such as diols and dicarboxylic acids, and ratios of constituent monomers, and the reactivity of these polyester resins were examined. As a result, it was found that all the polyester resins except for those prepared using some nitrogen-containing monomers exhibited no reactivity with the aminium salt compound.

Therefore, when two resins of a polyester resin and a styrene-acrylic resin, for example, are selected as the two resin different from each other in the solubility parameter, it is still preferred that an aminium salt compound be dispersed in the polyester with the charge control agent dispersed in the styrene-acrylic resin.

The experience of the present inventors indicates that the resin for dispersing the charge control agent is preferably a resin having a higher melt viscosity. This is because the dispersion of the charge control agent in a resin having a higher melt viscosity enables a desired charge control effect to be attained by addition of the charge control agent in a smaller amount.

Examples of the resin having a high melt viscosity include crosslinking polyester resins comprising as indispensable constituent monomers multifunctional acids and multifunctional alcohols, such as trimellitic acid and pentaerythritol, and crosslinking styrene-acrylic resins comprising as indispensable constituent monomers divinylbenzene or the like.

The present inventors have found that, in the construction which takes the above-described requirements into consideration and can attain the object of the present invention, the addition of an aminium salt compound to a polyester resin or a polyamide resin is still preferred, while with respect to the resin for dispersing the positive charge control agent, since the resin should have a solubility parameter remarkably different from the polyester resin and polyamide resin, a styrene-acrylic resin or a styrene-butadiene resin having a crosslink or the like and properties somewhat like those of high-viscosity resins is still preferably used for the purpose of usefully attaining the effect of the present invention.

In practicing the present invention, at the outset, it is necessary that an aminium salt compound be dispersed in any one of a plurality of binder resins different from each other in the solubility parameter and a positive charge control agent be dispersed in another binder resin. With respect to techniques where internal additives, such as an aminium salt compound and a positive charge control agent, are added to these binder resins, use may be made of a technique where these internal additives are dispersed during polymerization of the binder resin, a technique where the internal additives are dispersed by kneading after the binder resin is produced, and other techniques. The present invention can be practiced by any of the above-described techniques.

When the technique where the internal additives are added during the polymerization of the resin is compared with the techniques where the internal additives are added by kneading, the dispersion of the internal additives during the polymerization of the resin is more advantageous from the viewpoint of the dispersion efficiency of the internal additives and the production cost. However, there is a problem that the aminium salt compounds and the quaternary ammonium salts and other salts commonly used as the charge control agent has poor heat resistance and causes a change in properties at a temperature below 200° C., which unfavorably limits the binder resins for toners.

Thereafter, the binder resins containing the above internal additives as the indispensable component are combined with each other to form a toner. In this case, use may be made of two methods, that is, a method in which the toner is formed by kneading and pulverization and a method in which the toner is formed by aggregation and heating in a liquid phase. In the method in which the toner is formed by kneading and pulverization, a desired toner can be prepared by mixing a binder resin containing an aminium salt compound with a binder resin containing a positive charge control agent and optional internal additives, such as coloring materials and waxes, melting and kneading the mixture by means of a kneader, an extruder or the like and subjecting the kneaded product to pulverization and classification using a pulverizer such as a jet mill. A fine powder of a resin in which an aminium salt compound has been dissolved or dispersed can be prepared, for example, by using as the resin for dispersing or dissoving the aminium salt compound a polyester resin comprising as a main dicarboxylic acid monomer moiety terephthalic acid and as a main diol monomer moiety an alkylene oxide adduct of bisphenol A, effecting the above-described dispersion by kneading and then pulverizing the kneaded product with a Rotoplex pulverizer to provide a pulverized product in a pellet form having a particle diameter of about 1 to 5 mm.

In the kneading, when the degree of dispersion of the binder resin containing an aminium salt compound in a dispersed state and the binder resin containing a positive charge control agent in a dispersed state in each other is excessively low, toner particles consisting of one resin component alone are unfavorably present in toner particles after pulverization and classification. On the other hand, when the kneading intensity is high enough to provide a good dispersion of both resins, the proportion of the aminium salt compound and the positive charge control agent which react with each other at the interface of the so-called "sea" and "islands" is increased, so that it becomes impossible for the toner to have a combination of a desired light absorption capability with a desired charge control capability.

In this connection, experience of the present inventors indicates that it is preferred that both the resins be relatively mildly kneaded with each other. In the mild kneading, if the dispersion of other internal additives, such as coloring material and wax, does not reach a desired state, it is also possible to disperse other internal additives, such as coloring material and wax, when the positive charge control agent or aminium salt compound is dispersed in the binder resin.

On the other hand, the method in which the toner is formed by aggregation and heating in a liquid phase comprises dispersing in a liquid phase a fine powder of a resin containing an aminium salt compound in a dispersed or dissolved state and a fine powder of a resin containing a positive charge control agent in a dispersed or dissolved state (a fine powder of a resin having a charge control capability being also usable), aggregating the resin powders by using means such as control of chargeability of the fine powders of the resins in the liquid phase and further heating the resin powder aggregates to partially melt them for binding, thereby forming a toner. For example, a fine powder of a binder resin, in which an aminium salt compound has been previously dispersed or dissolved, and a fine powder of a thermoplastic resin comprising as indispensable components a binder resin, in which a positive charge control agent has been previously dispersed or dissolved, and/or a fine powder of a thermoplastic resin of an eunine-functional-group-containing resin are subjected to aggregation and binding of several tens to several tens of thousands of particles in a liquid phase.

In the toner formed by this method, the "sea" and "islands" contemplated in the present invention can be formed more clearly than those in the toner formed by kneading and pulverization, and this method is the best method for practicing the present invention. A task to be accomplished when this method is put to practical use is how to provide a fine powder of the resin (primary particles) in which an aminium salt compound or a charge control agent has been dispersed.

Studies conducted by the present inventors have revealed that, when a styrene-acrylic resin is used as the binder resin, the use of the suspension polymerization, emulsion polymerization and other polymerization methods enable spherical particles having an approximate size in the range of from submicrons to about 2 μm to be provided and a charge control agent can be incorporated in these particles.

On the other hand, in the case of an epoxy resin or a polyester resin of which the solubility parameter is greatly different from that of the styrene-acrylic resin, a resin powder cannot be provided in the above-described polymerization method, and the aminium salt compound is decomposed during the polymerization of the resin to lose its function.

The present inventors have found that the use of a bisphenol A or F epoxy resin and an amorphous polyester resin comprising as main monomers a short straight-chain diol having a methyl side chain and an asymmetric carbon atom and terephthalic acid is effective for dispersing the aminium salt compound. In these resins, the pulverization efficiency is very high, and a fine powder having a size of 2 μm or less can be easily formed by using a conventional jet mill.

Specifically, a fine powder of a resin in which an aminium salt compound (2) has been dissolved or dispersed is provided by using, as an indispensable constituent monomer of the binder in which an aminium salt compound (2) is dispersed or dissolved, a polyester resin comprising 30% by mole or more of a short-chain diol having an asymmetric carbon with 5 or less carbon atoms and 30% by mole or more of terephthalic acid or an epoxy resin comprising bisphenol A or bisphenol F, effecting the dispersion by kneading and pulverizing the kneaded product to a powder having an average particle diameter of 2 μm or less and a maximum particle diameter of 5 μm or less.

Further, according to studies conducted by the present inventors, in the formation of the toner by aggregation and heating, when a fine powder of a resin having a low melting point is further added in addition to a binder resin containing an aminium salt compound in a dispersed state and a binder resin containing a positive charge control agent in a dispersed state and the three kinds of resins are subjected to melting and binding at such a temperature that only the low-melting resin is melted with the binder resin containing an aminium salt compound in a dispersed state and the binder resin containing a positive charge control agent in a dispersed state remaining unmelted, the reaction of the aminium salt confound with the positive charge control agent is minimized, which enables a combination of an excellent light absorption capability with an excellent charge control capability to be attained.

More specifically, a fine powder of a binder resin (a first fine powder of the resin), in which an aminium salt compound has been previously dispersed or dissolved, and a fine powder of a binder resin comprising as indispensable components a fine powder of a binder resin, in which a positive charge control agent (3) has been previously dispersed or dissolved, and/or a fine powder of a thermoplastic resin of an amine-functional-group-containing resin (a second fine powder of the resin) and a third fine powder of a thermoplastic resin having a melting temperature below that of the first and second fine powders of the resins are subjected to aggregation of several tens to several tens of thousands of particles in a liquid phase, and the liquid phase is then heated at such a temperature that the first and second fine powders of the resins remain unmelted with the third fine powder of the resin melted to bind the fine powders of the resins with one another.

Means (ii)

At the outset, a toner containing an aminium salt compound is produced. Thereafter, a charge control agent or a resin powder containing a charge control agent is deposited on the outer periphery of the toner (hereinafter referred to as "external addition"), or alternatively a film of a charge control agent or a resin containing a charge control agent is formed on the surface layer of the toner containing an aminium salt compound, which enables a charge control capability to be imparted to the surface layer of the toner and an excellent light absorption capability to be imparted to the interior of the toner. Consequently, a toner capable of satisfying both the fixability and chargeability requirements can be provided.

The average particle diameter of the external additive resin is preferably 0.5 μm or less.

Quaternary ammonium salts and amine-functional-group-containing resins may be used as the charge control agent.

The charge control capability can be imparted to the surface of the toner by two methods, that is, the external addition of a resin powder having an excellent charge control capability and the formation of a film. Practice of the present invention by using the external addition of the resin has advantages such as simpleness and the merit of low cost. However, since the external additive resin is held on the surface of the base toner containing an aminium salt compound by electrostatic force derived from triboelectrification between the resin powder and the surface of the base toner, if the triboelectricability of both the resin powder and the surface of the base toner is not on a proper level, they are subjected to stress by stirring in a developing unit, which unfavorably causes the external additive powder to be separated from the surface of the toner. For this reason, it is preferred to use the method in which a resin film layer having an excellent charge control capability is formed on the surface layer of the base toner.

In the formation of a film layer on the surface layer of the toner, it is also possible to use a method which comprises dissolving a material for the film layer in a solvent, coating the solution on the surface of the base toner particles by spray drying or the like. A film formation method best fit for attaining the object of the present invention is a mechanofusion method which comprises subjecting a fine powder of the resin as a material for the film layer to electrostatic adsorption onto the surface layer of the base toner particles and heating and pressing the surface of the toner by mechanical shock to melt the fine powder of the resin as the material for the film layer, thereby bringing the fine powder to a film. In the mechanofusion method, since no solvent is used as the medium, no wide range of surface of the base toner is dissolved, so that the reaction of the aminium salt in the base toner with the charge control agent in the film layer material can be minimized.

Means (iii)

In order to solve the above-described problem, the present inventors have found that the formation of a function separated toner wherein a charge control capability is imparted to the base toner particles with a light absorption capability imparted to the thermoplastic resin powder externally added to the surface of the toner particles prevents the reaction of the charge control agent with the aminium salt compound, enables the function of the charge control agent added mainly to the base toner to be utilized and enables the aminium salt compound added to the external additive resin to generate heat with a good light absorption in the step of fixing, which heat is transferred from the external additive resin to the base toner to melt the whole toner, so that it becomes possible to attain flash fixability.

The average particle diameter of the externally added fine powder of the resin is preferably in the range of from 0.5 to 5.0 μm. The content of the aminium salt compound in the fine powder of the resin is preferably in the range of from 10 to 50% by weight. The amount of the externally added fine powder of the resin is preferably in the range of from 2 to 5% by weight based on the toner, and the content of the aminium salt compound is preferably 0.5% by weight or more based on the total weight of the toner. The reason for the above limitation is as follows. When the average particle diameter is smaller than the above-described range, the amount of the aminium-salt-compound-containing fine powder of the resin deposited on the surface of the toner becomes small. On the other hand, when the average particle diameter is excessively large, it becomes difficult to deposit the fine powder of the resin on the surface of the toner. With respect to the amount of the fine powder of the resin, the amount of the aminium salt compound added to the fine powder of the resin, etc., when the amount is smaller than the above-described range, the amount of the aminium salt compound added based on the total amount of the toner becomes so insufficient that the fusing of the toner becomes difficult, while when it is excessively large, the influence of the aminium salt compound on the color tone of the toner cannot neglected and, at the same time, the electrical resistance of the fine resin powder becomes so low that it becomes difficult to electrostatically deposit the fine powder of the resin on the base toner.

The externally added fine powder of the resin according to the present invention may be any fine powder of the resin so far as it is a thermoplastic resin nonreactive with the aminium salt compound. However, when use is made of a method for producing a fine resin powder, in which an aminium salt compound is melt-kneaded with the fine powder of the resin and the kneaded product is pulverized with a jet mill or the like to provide a desired fine powder of the resin, the use of an epoxy resin comprising bisphenol A or bisphenol F or an amorphous polyester resin comprising 30% by mole or more of a short straight-chain diol (5 or less carbon atoms) having a methyl side chain with an asymmetric carbon and 30% by weight or more of terephthalic acid is recommended. This is because the above-described resin is nonreactive with the aminium salt compound and has a very good pulverizability, so that a fine powder of the resin having a desired particle diameter can be easily provided. With respect to the method for producing a fine powder of the resin other than the pulverization method, the fine powder of the powder can be produced also by subjecting a melt mixture of a thermoplastic resin dissolved in an organic solvent with an aminium salt compound to spray drying.

Means (iv)

The present inventors have found that, in a toner containing an aminium salt compound, wherein a material having a basic site-having a high reactivity with an aminium salt compound co-exists with an aminum salt compound in the introduction of a material having a higher reactivity with said basic site-having material than the aminium salt compound, for example, a sulfonic acid or a carboxylic acid, enables the reaction of said basic site-having material with the aminium salt compound to be alleviated.

Examples of the functional group, which can exhibit the effect contemplated in the present invention, include acidic functional groups such as carboxylic acids and sulfonic acids. Materials having these functional groups include polyester resins, and polyacrylic resins and styrene-acrylic resins comprising as an indispensable monomer a carboxylic-acid-containing monomer, such as acrylic acid.

In order to effectively attain the effect of the present invention, it is preferred for the acidic functional group to have an acid value of 30 mg/KOH or more.

In the present invention, examples of the material having a basic site introduced for the purpose of imparting a positive chargeability include quaternary ammonium salts and amine-functional-group-containing resins. The effect contemplated in the present invention can be attained when the amine-functional-group-containing resin is any of copolymers comprising as indispensable monomers styrene and/or acrylate and/or aminoacrylate. A better effect can be attained when amine-modified polyacrylates and amine-modified styrene-acrylates, having in their structure aminoacrylate as an indispensable monomer, are used as the material having a basic site introduced for the purpose of imparting a positive chargeability.

In this case, the equivalent of the acidic functional group of the acidic-functional-group-containing resin is preferably ½ to 2 times the equivalent of the amine of the amine-functional-group-containing resin.

The toner according to the present invention can be prepared also by a conventional method for producing a toner, which comprises melt-kneading an aminium salt compound, a resin and/or a positive charge control agent for imparting a positive chargeability, a binder resin having an acidic functional group, a coloring material, etc. together and then subjecting the kneaded product to pulverization and classification. However, in order to more effectively attain the effect of the present invention, it is more effective to use a two-stage kneading method in which the binder resin containing an acidic functional group is first melt-kneaded with a resin and/or a positive charge control agent for imparting a positive chargeability, for example, a quaternary ammonium or a resin containing an amine functional group, such as a styrene-dimethylaminoethyl methacrylate copolymer to produce a resin mixture that is then melt-kneaded with a coloring material, aminium salt compound, etc.

It is also possible to mix the binder resin containing an acidic functional group with a resin and/or a positive charge control agent for imparting a positive chargeability by adding one of the resins during production of the other resin by polymerization.

Means (v)

It has been found that a binder resin having a particular chemical structure exhibits a mild positive chargeability and is not detrimental to the light absorption capability of the aminium salt compound and the chargeability imparting capability.

The binder resin according to the present invention has a lower basicity than aliphatic tertiary amines including a styrene-dimethylaminoethyl methacrylate and quaternary ammonium salts, so that it is less likely to cause a reaction for abstracting a salt of the aminium salt compound. Further, it has a positive chargeability enough to compensate for the positive chargeability lost by the aminium salt compound. The binder resin capable of satisfying the above-described property requirement can be found in thermoplastic resins which can take nitrogen-containing cyclic structures, such as an imidazole ring, a pyrimidine ring, a pyrrolidone ring, a pyrazole ring, a pyrroline ring and a pyrrole ring, and/or take structures wherein an amide group represented by the formula —$RCONH_2$ (wherein R represents a benzene ring or an aliphatic hydrocarbon having 0 to 2 carbon atoms) is coordinated in a pendant form to the molecular chain of the binder. The thermoplastic resins having the above-described structure and capable of satisfying the heat-meltability and rheological property requirements for the binder resin of the toner can be provided in the form of styrene and a styrene-acrylate copolymer comprising as an indispensable constituent monomer a vinyl monomer having a nitrogen-containing ring structure, such as vinylpyrrolidone, and/or an acrylic amide monomer.

The copolymerization ratio of the acrylamide monomer and the monomer having a nitrogen-containing cyclic structure is preferably in the range of from 10 to 20% by mole. This is because when the copolymerization ratio is less than 10% by mole, the binder resin does not often exhibit a desired positive chargeability, while when the ratio exceeds 20% by mole, it becomes difficult to satisfy the heat-meltability and rheological property requirements for the binder resin for the toner with the above-described monomer used in such a large amount and, in extreme case, the degree of the salt abstraction reaction with the aminium salt compound exceeds an acceptable level.

The binder which has a mild positive chargeability and is not detrimental to the light absorption capability of the aminium salt compound and the capability of imparting a chargeability include, besides the above-described resins having an amide group or a pendant structure of a nitrogen-containing ring, amide monomers and amide resins, such as polyamide resins, amine-modified polyester resins comprising as an indispensable constituent monomer aminodicarboxylic acids or aminodiols (more specifically amine-modified polyesters comprising polyester resins having an acid value of 15 or more wherein 10 to 30% of the carboxylic acid end is subjected to amide blocking with monoamine or crosslinking with diamine), urethane-modified polyester resins having terminal hydroxyl groups blocked with urethane, such as isocyanate, (more specifically urethane-modified polyester resins comprising polyester resins having an OH value of 10 or more wherein 20% or more of the alcohol end is blocked with urethane) and amine-modified epoxy resins wherein both ends of the diamine is reacted with a hydroxyl group of the epoxy resin to cause crosslinking.

When the amide monomer is used as the binder, it is preferred to use a compound having a molecular weight of about 500 to 3,000 for the purpose of attaining a combination of the heat-meltability with resistance against filming the photoconductor drum.

Since the polyester resins generally have a negative chargeability, it is preferred to use an amino monomer for the purpose of imparting a positive chargeability, and the polymerization ratio of the amino monomer is preferably 10 to 30% by mole for the purpose of satisfying the requirements of the present invention. In the case of the urethane-modified polyester resin, 20% or more of the alcohol end of preferably the polyester resin having an OH value of 10 or more is preferably blocked with urethane.

Means (vi)

When use is made of a charge control agent having a salt structure such as a quaternary ammonium salt, an anion constituting the aminium salt compound and an anion constituting the charge control agent having a salt structure are selected to be a common ion.

Specifically, quaternary ammonium salts represented by the following general formula (3) are used as the positive charge control agent:

$$[R^1-\overset{\overset{R^2}{|}}{\underset{\underset{R^3}{|}}{N^+}}-R^4]_n nX^- \quad (3)$$

wherein $R^1$ to $R^4$ represent an arbitrary alkyl group, a phenyl group or its derivative and $X^-$ represents the same anion as defined above in connection with the general formulae (1) and (2).

This prevents the aminium salt compound and the charge control agent from causing a structural change, which enables the aminium salt compound and the charge control agent to maintain their inherent functions, so that a toner having a combination of a good fixability with a good chargeability can be provided.

The aminium salt compound having a high infrared light absorption capability and a light color tone in the visible light region includes perchlorates, fluoroborates, hexafluoroarsenates, hexafluoroantimonate and alkylsulfonates. On the other hand, sulfonate quaternary ammonium salts and molybdate quaternary ammonium salts are commonly used as quaternary ammonium salts having a high charge control capability. The anion species capable of providing both an excellent light absorption capability in the aminium salt compound and an excellent charge control capability in the molybdate quaternary ammonium salt include anions such as sulfonate ion and molybdate ion. Relatively good properties can be attained also when perchlorate ion and fluoroborate ion are used as the anion species. In this case, however, there is a little room for an improvement in the charge control capability, particularly increasing of charge in the quaternary ammonium salt. In this connection, it has been found that, in toners required to have a high charge controllability, when a perchlorate ion or a fluoroborate ion is selected as a common anion species, the combined use of these anion species and a very small amount of a sulfonate quaternary ammonium salt or a molybdate quaternary ammonium salt can provide an excellent performance. In this case, when use is made of a quaternary ammonium salt having an anion different from the anion of the aminium salt compound, there is a possibility of the above-described salt exchange reaction occurring. However, when the amount of the quaternary ammonium salt having a different anion added is ⅕ equivalent or less of the amount of the aminium salt compound added, although part of the function of the aminium salt compound is lost, the infrared light absorption capability of the whole toner is not significantly lowered, so that it becomes possible to attain a combination of an excellent charge control capability with an excellent infrared light absorption capability.

It is also possible to improve the control of chargeability of the toner by using amine compounds as the additional binder resin or other additives. The amine compounds in this case too produce a possibility that the ion-abstracting reaction of the aminium salt compound occurs. However, as with the sulfonate quaternary ammonium salts and molybdate quaternary ammonium salts, when the amount of the amine compound in the toner is ⅕ equivalent or less of the amount of the aminium salt used, the infrared light absorption capability of the whole toner is not significantly lowered and the presence of the amine group contributes to an improvement in charge control capability, so that it becomes possible to attain a combination of an excellent charge control capability with an excellent infrared light absorption capability.

Means (vii)

Studies conducted by the present inventors have revealed that, when the compound represented by the general formula (1) is compared with the compound represented by the general formula (2), the compound represented by the general formula (2) is advantageous over the compound represented by the formula (1) in that it has a higher capability of a positive charge and a higher light absorption capability. It, however, has a problem of a somewhat deep color tone, and when the compound represented by the general formula (2) alone is used as the infrared light absorber, there is a tendency that the tone of the color toner is somewhat dull. The present inventors have found that the use of a blend of the compound represented by the formula (1) with the compound represented by the formula (2) can provide a toner that can satisfy the chargeability capability, light absorption capability and color tone requirements.

According to studies conducted by the present inventors, the amounts of the compound (monovalent) represented by the formula (1) and the compound (divalent) represented by the formula (2) blended are preferably 60 to 80% by weight and 40 to 20% by weight, respectively, for the purpose of preventing influence on the color toner.

Further, the present inventors have found that, in the aminium salt compound, the chargeability capability, color tone in the visible region, light absorption capability and reactivity with the charge control agent vary somewhat depending upon anion species and, as with the confined use of the compound represented by the general formula (1) and the compound represented by the general formula (2), the combined use of the aminium salt compounds different from each other in the above-described properties can provide a toner capable of satisfying all the chargeability capability, light absorption capability and color tone requirements.

Means (viii)

As a result of studies, the present inventors have found that, when the aminium salt compounds represented by the general formulae (1) and (2) are used in combination with compounds having a capability of absorbing infrared light, such as ammonium salts of aromatic dithiols and mercaptophenols and diamine metal complexes and polyenylidenebisbenzoquinones and phthalocyanine compounds represented by the general formulae (4) to (8), even though a quaternary ammonium salt charge control agent is added to the toner, the compounds represented by the general formulae (4) to (8), which are nonreactive with the quaternary ammonium salts, can compensate for the light absorption capability of the aminium salt compound lost by the reaction of the aminium salt compounds with the quaternary ammonium salts, so that it becomes possible to impart a good absorption capability to the color toner.

The compounds represented by the general formula (4) are dithiol compounds, the compounds represented by the general formula (5) are mercaptophenol and mercaptonaphthol compounds, the compounds represented by the general formula (6) are diamine compounds, the compounds represented by the general formula (7) are polyenylidenebisbenzoquinone compounds, and the compounds represented by the general formula (8) are phthalocyanine and naphthalocyanine compounds. When the ammonium salts of aromatic dithiols and mercaptophenols and dimnine metal complexes and polyenylidenebisbenzoquinones and phthalocyanine compounds are used as the additional infrared light absorber in combination with the aminium salt compounds, the content of the infrared light absorber additionally used in combination with the aminium salt compound should be 1% by weight or less, preferably 0.5% by weight or less, for the purpose of suppressing the odor generated accompanying the fixation and the influence on the tone of the color to acceptable levels.

On the other hand, when the phthalocyanine compounds are used as the additional infrared light absorber, the odor generated during the fixing is not very significant. However, many of these phthalocyanine compounds have a color tone in the visible region ranging from strong blue to green, so that the addition thereof even in a small amount has a great influence on the tone of the toner. For this reason, when they are added to toners having a color tone different from that inherent in the phthalocyanine compounds, such as red and yellow toners, the content of the phthalocyanine compound should be limited to 1% by weight or less, preferably 0.2% by weight or less.

In a preferred embodiment of the present invention, fine particles of amide compounds represented by the general formulae (9) to (11) are further deposited (externally added) onto the surface of the toner.

$$R^5\underset{\underset{OH}{|}}{C}(CH_2)_nCONR^7 \quad (9)$$

$$R^5\underset{\underset{OH}{|}}{C}H(CH_2)_lCON(CH_2)_mNCO(CH_2)_n\underset{\underset{OH}{|}}{C}HR^8 \quad (10)$$

In the formulae (9) and (10), l, m and n are integers of 0 and 4, and $R^5$ to $R^8$ represent hydrogen, an alkyl group, a halogen-substituted alkyl group, an aryl group or a halogen-substituted aryl group.

$$R^5\left[CH_2\underset{\underset{OH}{|}}{C}H(CH_2)_lCON\right]_mR^7 \quad (11)$$

In the formula (11), l and m are positive integers, and $R^5$ to $R^7$ are as defined above.

The present inventors have found that when a powder of an amide compound having a hydroxyl group in its molecular structure is externally added in a suitable amount to the toner, the flash fusibility of the toner can be improved without the occurrence of unfavorable phenomena, such as toner blocking and filming on a photoconductor drum.

The mechanism through which the above effect can be attained is believed to be as follows. In this toner, the amide compound as the external additive resin is first melted somewhat prior to the melting of the whole toner. The melted amide compound rapidly penetrates between fibers constituting paper because it has in its molecular structure a site having a high polarity, such as an amide group (including an amide bond) or a hydroxyl group, a high affinity for fibers constituting paper, a lower melting point than the binder resin constituting the toner and a low melt viscosity. This effect enhances the wettability of the paper fibers by the melted binder resin, so that the binder resin (base toner) having a somewhat high melt viscosity also penetrates between the paper fibers to provide an excellent fixation. Therefore, a good fixability (fusibility) can be imparted even when the melt viscosity is high because the light absorption of the toner is unsatisfactory and the temperature of the binder is low.

The amide compound having the above-described properties include hydroxyfatty acid monoamides, hydroxyfatty acid bisamides and low-molecular weight polyamide oligomers containing a hydroxyl group. The weight average molecular weight of the amide compound is preferably in the range of from 500 to 3,000. This is because when the molecular weight is below this range, since the amide compound becomes so soft that the drum filming is likely to occur, while when it exceeds 3000 or more, in many cases, the melt viscosity becomes so high that it is difficult to attain the effect.

In order to satisfactorily attain the effect, the amide resin should be melted earlier than the base toner, and, at the same time, the melt viscosity should be low. For this reason, the melting temperature of the amide compound to be externally added should be 10° C. or more below the melting temperature of the binder resin constituting the toner matrix and in a melting temperature region of the melted toner in the vicinity of recording paper. The melting viscosity in the temperature range of from 100° to 150° C. should be lower than that of the binder resin constituting the base toner.

The same effect can be attained also in the case of a toner wherein the amide compound is internally added to the toner, that is, melt-kneaded together with the binder resin. In this case, the amide compound should be added in an amount of 5% by weight or more, preferably 20% by weight or more. However, many of the amide compounds are relatively soft and fragile, and the addition of the amide compound having the above properties in a large amount causes a thin film of the amide compound to be formed on a photoconductor drum when printing is effected for a long period of time, that is, gives rise to the so-called "drum filming" that is causative of printing troubles such as smudge. In order to successfully prevent the occurrence of drum filming even during printing for a long period of time, it is necessary for the amount of the amide compound to be 2% by weight or less, preferably 1% by weight or less. In this case, it is preferred that the amide compound be externally added to the toner for the purpose of attaining the above-described good fixation effect.

The amide compound to be externally added preferably has an average particle diameter of 2 μm or less and a maximum particle diameter of 5 μm or less. This is because when the particle diameter of the amide compound to be externally added exceeds the above-described range, the particles cannot be deposited homogeneously on the surface of the toner and therefore become liable to peel from the toner, which gives rise to a problem such as accumulation of the amide compound in a developing device.

It is noted that this embodiment is not only useful in combination with the means (i) to (viii) but also can be usefully applied to any other flash fixing toners.

Process for Producing Toner

Any of general and special processes for producing flash fixing color toners of the present invention described above in connection with each means are provided by the present invention. Details of these processes are as described above and therefore need not be repeated again. The production processes described in the scope of claims for the patent is particularly unique.

EXAMPLES

The present invention will now be described in more detail with reference to the following Examples, though it is not limited to these examples only.

Measurement of Light Absorption Wavelength of Binder Resin Containing Infrared Light Absorption Agent The wavelength of light having the highest intensity produced by a xenon lamp which is used for flash fixing is in the range of from 800 to 1000 nm. Various resins containing 1% by weight of an aminium salt compound, which is represented by the general formula (1) and has a perchlorate ion as the anion (this aminium salt compound was used in all the following Examples unless otherwise specified), were subjected to examination of light absorption properties by placing a resin powder under test together with an aminium salt compound in a stainless Petri dish, gently melt-mixing them on a hot plate at 150° C. (while observing the color tone), allowing the as-mixed resin to cool, cut the cooled resin into a thin film and subjecting the thin film to examination of light absorption properties with an infrared absorptiometer.

The results are given in Table 1.

TABLE 1

| Name of resins (all the resins containing 1% of aminium salt compound) | Absorbence at 800–1000 nm | Color tone |
|---|---|---|
| [Base] | | |
| ① Polyester resin | 92–95% absorbed | light green |
| ② polyester resin + 1% quaternary ammonium salt added | 15–20% absorbed | brown |
| [Amine resin] | | |
| ③ Methyl methacrylate(66 mol %)-dimethylaminoethyl methacrylate(34 mol %) | 35–50% absorbed | brown |
| ④ Methyl methacrylate(80 mol %)-dimethylaminoethyl methacrylate(20 mol %) | 40–60% absorbed | brown |

TABLE 1-continued

| Name of resins (all the resins containing 1% of aminium salt compound) | Absorbence at 800–1000 nm | Color tone |
|---|---|---|
| ⑤ Styrene(70 mol %)-dimethylaminoethyl methacrylate(30 mol %) | 30–40% absorbed | brown |
| ⑥ Styrene(80 mol %)-dimethylaminoethyl methacrylate(20 mol %) | 30–40% absorbed | brown |
| ⑦ Styrene(90 mol %)-dimethylaminoethyl methacrylate(10 mol %) | 45–60% absorbed | light brown |
| [Cyclic nitrogen-containing resin] | | |
| ⑧ Styrene(80 mol %)-vinylpyrrolidone(20 mol %) | 66–80% absorbed | light green |
| ⑨ Methyl methacrylate(85 mol %)-vinylpyrimidine(15 mol %) | 70–84% absorbed | light green |
| [Amide compound] | | |
| ⑩ Styrene(80 mol %)-dimethylacrylamide(20 mol %) | 82–90% absorbed | light green |
| ⑪ Styrene(35 mol %)-dimethylacrylamide(35 mol %)-methyl methacrylate(30 mol %) | 85–92% absorbed | light green |
| ⑫ Propylenebishydroxyarachic amide | 92–98% absorbed | light green |
| [General-purpose styrene-acrylic resin] | | |
| ⑬ Styrene(75 mol %)-2-ethylhexyl acrylate(25 mol %) | 70–80% absorbed | light green |
| ⑭ Styrene(75 mol %)-n-butyl acrylate(25 mol %) | 77–88% absorbed | light green |
| [Others] | | |
| ⑮ Polyester end-blocked with urethane | 75–85% absorbed | light green |
| ⑯ Polyester containing pyridine ring (structure unknown) | 88–94% absorbed | light green |
| ⑰ Polyester end-blocked with amide (estimated amide content: 5 mol %) | — | light green |
| ⑱ Polyester end-blocked with amide (estimated amide content: 15 mol %) | — | greenish brown |
| ⑲ Polyester end-blocked with amide (estimated amide content: 25 mol %) | — | light brown |
| ⑳ N-Aminoethylpiperazine-crosslinked epoxy | — | light green |
| ㉑ m-Xylenediamine-crosslinked epoxy | 85–92% absorbed | light green |

Means (i)

Example 1

A polyester resin comprising an ethylene oxide adduct of bisphenol A as a main diol monomer moiety and terephthalic acid as a main dicarboxylic acid monomer moiety was used a binder resin 1-1, and 2% of an aminium salt compound 2, which is represented by the general formula (1) and has a perchlorate ion as the anion, was added and kneaded with the binder resin 1-1. The kneaded product is designated as "kneaded product A".

Then, 1% of a quaternary ammonium salt as a positive charge control agent 3 was added to a styrene-acrylic resin (a styrene-methyl methacrylate-n-butyl methacrylate copolymer) as a binder resin 1-2. Further, 2% of brominated copper phthalocyanine as a coloring material 4 and 1% of polypropylene wax as a fixation assistant 5 were added thereto, and they were melt-kneaded with each other. The kneaded product is designated as "kneaded product B".

The difference in the solubility parameter between the polyester resin and the styrene-acrylic resin was calculated and found to be about 0.8. Thereafter, a coarsely crushed kneaded product A and a coarsely crushed kneaded product B were blended with each other in a ratio of 7:3. The blend was subjected to melt kneading, pulverized and classified to provide a toner C.

The toner C was combined with a ferrite carrier to provide a developer which was then mounted on a printer F6718K (manufactured by Fijitsu, Ltd.) and subjected to examination for flash fixability (fusibility) and chargeability under high-temperature and high-humidity conditions.

As a result, the sample exhibited an excellent fixability of 90% in terms of the percentage fixation (tape peeling test). With respect to the chargeability, the developer was exposed to an environment of 35° C. and 80% RH for 12 hr and subjected to stirring in a developing unit in the same environment for 3 min. As a result, the amount of charge recovered to about 80% of that under room temperature and ordinary humidity conditions (this value being hereinafter referred to as "recovery of charge") by stirring for 3 min. That is, it was confirmed that the sample had an excellent chargeability.

The same effect as that of this example could be attained also when the procedure of the present example was repeated, except that other polyester resins and/or polyamide resins were used instead of the polyester resin used in this example and styrene-butadiene resins were used instead of the styrene-acrylic resin.

The effect attained by combinations of the polyester resin with binder resins other than the styrene-acrylic resin is given in the following table.

| Binder resin 1-1 | Binder resin 1-2 | Fixation (%) | Recovery of charge (%) |
|---|---|---|---|
| Polyester | Styrene-acrylic | 90 | 80 |
| Polyester | Styrene-acrylic | 85 | 95 |
| Polyester | Styrene-butadiene | 80 | 95 |
| Epoxy | Styrene-acrylic | 100 | 80 |
| Polyamide | Styrene-acrylic | 75 | 80 |

Example 2

A polyester resin comprising an ethylene oxide adduct of bisphenol A as a main diol monomer moiety and terephthalic acid as a main dicarboxylic acid monomer moiety was used as a binder resin 1-1, and 2% of an aminium salt compound, 2% of brominated copper phthalocyanine and 1% of polypropylene wax were added and kneaded with the binder resin 1-1. The kneaded product is designated as "kneaded product D".

Then, the kneaded product D and a binder resin 1-2 of an amine-modified styrene-acrylic resin comprising dimethylaminoethyl methacrylate as an indispensable constituent monomer were melt-kneaded with each other in a ratio of 9:1, and the kneaded product was pulverized and classified to provide a toner E.

The toner E was subjected to examination for fixability and chargeability in the same manner as that of Example 1. As a result, it exhibited excellent properties, i.e., a fixation of 85% and a recovery of charge of 70%.

Example 3

A toner F was prepared in the same manner as that of Example 2, except that the amine-modified styrene-acrylic resin was in the form of submicron particles having a melting point of 200° C. or above.

The toner F was subjected to examination for fixability and chargeability in the same manner as that of Example 1. As a result, it exhibited excellent properties, i.e., a fixation of 80% and a recovery of charge of 90%.

Example 4

The kneaded product D provided in Example 2 and a styrene-acrylic resin (a styrene-n-butyl-acrylate copolymer) containing 2% of a quaternary ammonium salt added during synthesis of the resin were melt-kneaded with each other in a ratio of 7:3, and the kneaded product was pulverized and classified to provide a toner G.

The toner G was subjected to examination for fixability and chargeability in the same manner as that of Example 1. As a result, it exhibited excellent properties, i.e., a fixation of 85% and a recovery of charge of 70%.

Example 5

A bisphenol A type epoxy resin (epoxy equivalent: 900) was melt-kneaded with 3% of an aminium salt compound, and the kneaded product was pulverized with a jet mill to provide a pulverized product H having a particle size of 2 μm or less. A submicron spherical resin comprising a styrene-n-butyl acrylate-methyl methacrylate copolymer containing a quaternary ammonium salt was provided by emulsion polymerization. The spherical resin, pulverized product H and brominated copper phthalocyanine were heated in an aqueous phase to 120° C., aggregated and bound to each other to provide a toner I.

The toner I was subjected to examination for fixability and chargeability in the same manner as that of Example 1. As a result, it exhibited excellent properties, i.e., a fixation of 90% and a recovery of charge of 70%.

Example 6

A toner J was provided in the same manner as that of Example 5, except that a polyester resin having an average molecular weight of about 6,000, and comprising as indispensable constituent monomers 1,2-propylene glycol, neopentyl glycol and terephthalic acid, was used instead of the bisphenol A type epoxy resin provided in Example 5.

The toner J was subjected to examination for fixability and chargeability in the same manner as that of Example 1. As a result, it exhibited excellent properties, i.e., a fixation of 90% and a recovery of charge of 75%.

Example 7

A toner K was provided in the same manner as that of Example 6, except that 30% by weight of a styrene-n-butyl acrylate resin having a melting point of 90° C. was added and the heating temperature was 90° C.

The toner K was subjected to examination for fixability and chargeability in the same manner as that of Example 1. As a result, it exhibited excellent properties, i.e., a fixation of 100% and a recovery of charge of 85%.

Comparative Example 1

A polyester resin comprising an ethylene oxide adduct of bisphenol A as a main diol monomer moiety and terephthalic acid as a main dicarboxylic acid monomer moiety was used as a binder resin, and 2% of an aminium salt compound, 2% of brominated copper phthalocyanine and 1% of polypropylene wax were added thereto. The mixture was melt-kneaded and then pulverized and classified to provide a toner L.

The toner L was subjected to examination for fixability and chargeability in the same manner as that of Example 1. As a result, it exhibited a fixation of 100%. However, the recovery of charge was 30% or less. In this comparative example, since no positive charge control agent was added, the chargeability was very low.

Comparative Example 2

A toner M was provided in the same manner as that of Comparative Example 1, except that 1% of a quaternary ammonium salt represented by the chemical formula $[(CH_{14}H_{29})_2(CH_3)_2N^+]_4Mo_8O_{26}^{4-}$ was added as a positive charge control agent.

The toner M was subjected to examination for fixability and chargeability in the same manner as that of Example 1. As a result, it exhibited a fixation of 20% or less and a recovery of charge of 40% or less. That is, both the light absorption capability and chargeability were poor. Further, the color tone of the toner changed from green, i.e. the color tone of the coloring agent, to brown.

In this comparative example, the above-described unfavorable results are attributable to the addition of a positive charge control agent and an aminium salt compound to a single binder rather than a plurality of binder resins.

Comparative Example 3

A kneaded product A was provided in the same manner as that of Example 1. Separately, 1% of a quaternary ammonium salt as a positive charge control agent was added to a carboxylic-acid-modified-styrene-acrylic resin comprising methacrylic acid as an indispensable constituent monomer. Further, 2% of brominated copper phthalocyanine as a color material and 1% of polypropylene wax as a fixation assistant were added thereto, and the mixture was melt-kneaded. The resultant kneaded product is designated as "kneaded product N".

The difference in the solubility parameter between the polyester resin and the carboxylic-acid-modified-styrene-acrylic resin used was calculated and found to be about 0.2. The kneaded product A and the kneaded product N were melt-kneaded with each other in a ratio of 8:2, and the kneaded product was pulverized and classified to provide a toner O.

The toner O was subjected to examination for fixability and chargeability in the same manner as that of Example 1. As a result, it exhibited a fixation of 45% and a recovery of charge of 60%, i.e., did not reach the target performance. Further, the state of dispersion of the kneaded product A and the kneaded product N in the toner O was examined. As a result, it was found that although the kneaded products were not completely dissolved in each other, the formation of a clear "islands-sea structure" was not observed.

Comparative Example 4

The production of a toner was attempted in the same manner as that of Example 5, except that a polyester resin comprising an ethylene oxide adduct of bisphenol A as a main diol monomer moiety and terephthalic acid as a main dicarboxylic acid monomer moiety was used as the resin for dispersing the aminium salt compound instead of the bisphenol A type epoxy resin.

However, in Comparative Example 4, the resin in which the aminium salt compound had been dispersed could be pulverized only to about 4 to 6 μm in diameter by the conventional jet pulverization. It was impossible to provide a toner having a particle size in the range of from about 10 to 12 μm by subjecting the pulverized product to aggregation and fixation in an aqueous phase.

Means (ii)

Example 8

The toner L provided in Comparative Example 1 was mixed with 2% by weight of a divinylbenzene-styrene-dimethylaminoethyl methacrylate copolymer resin powder (copolymerization ratio; divinylbenzene:styrene:dimethylaminoethyl methacrylate=5:75:20/average particle diameter 0.1 μm) by stirring with a henschel mixer to provide a toner P containing an externally added divinylbenzene-styrene-dimethylaminoethyl methacrylate copolymer resin powder.

The toner P was combined with a Mn—Zn-based ferrite carrier coated with methyl methacrylate and subjected to measurement of the amount of charge. As a result, the amount of charge of the toner P under room temperature and ordinary humidity conditions was 20 μC./g. Subsequently, the developer was exposed to an environment of 35° C. and 80% RH for 12 hr, and stirred in the developing unit under the same environment for 3 min. As a result, the amount of charge was recovered to about 75% of that under room temperature and ordinary humidity conditions (this value being hereinafter referred to as "recovery of charge") by stirring for 3 min. Thus, it was confirmed that the sample had an excellent chargeability.

The above-described ferrite carrier coated with methyl methacrylate was combined with the toner P, mounted on an F6718K printer (manufactured by Fujitsu, Ltd.) to examine the printing properties. As a result, the sample exhibited excellent printing priorities with respect to 100,000 sheets.

Example 9

2% by weight of a styrene-n-butyl acrylate copolymer resin powder (copolymerization ratio; styrene:n-butyl acrylate=75:25/average particle diameter 0.1 μm) containing a quaternary ammonium salt represented by the chemical formula $[(CH_{14}H_{29})_2(CH_3)_2N^+]_4Mo_8O_{26}^{4-}$ incorporated during the polymerization was externally added and mixed with the toner L provided in Comparative Example 1 by stirring with a henschel mixer to provide a toner Q.

The toner Q was combined with a Mn—Zn-based ferrite carrier coated with methyl methacrylate and subjected to measurement of the amount of charge. As a result, the amount of charge of the toner Q under an environment of room temperature and ordinary humidity was 22 μC./g. Subsequently, the developer was exposed to an environment of 35° C. and 80% RH for 12 hr, and stirred in the developing unit under the same environment for 3 min. As a result, the amount of charge recovered to about 90% of that under room temperature and ordinary humidity conditions by stirring for 3 min. Thus, it was confirmed that the sample had an excellent chargeability.

The above-described ferrite carrier coated with methyl methacrylate was combined with the toner Q, mounted on an F6718K printer (manufactured by Fujitsu, Ltd.) to examine the printing properties. As a result, the sample exhibited excellent printing priorities with respect to 100,000 sheets.

Example 10

4% by weight of a powder of a styrene-n-butyl acrylate copolymer resin (copolymerization ratio; styrene:n-butyl acrylate=75:25/average particle diameter 0.1 μm) containing a quaternary ammonium salt and used in Example 2 was added to the toner L provided in Comparative Example 1. The mixture was placed in a hybridizer (manufactured by Nara Machinery Co., Ltd.), and pressure and mechanical shock were applied to provide a toner R comprising a toner L having a surface coated with a styrene-n-butyl acrylate copolymer resin containing a quaternary ammonium salt.

The toner R was combined with a Mn—Zn-based ferrite carrier coated with methyl methacrylate and subjected to measurement of the amount of charge. As a result, the amount of charge of the toner R under an environment of room temperature and ordinary humidity was 25 μC./g. Subsequently, the developer was exposed to an environment of 35° C. and 80% RH for 12 hr and stirred in the developing unit under the same environment for min. As a result, the amount of charge-recovered to about 85% of that under room temperature and ordinary humidity conditions. Thus, it was confirmed that the sample had an excellent chargeability.

The above-described ferrite carrier coated with methyl methacrylate was combined with the toner R, mounted on an F6718K printer (manufactured by Fujitsu, Ltd.) to examine the printing properties. As a result, the sample exhibited excellent printing priorities with respect to 100,000 sheets.

Example 11

4% by weight of a styrene-methyl methacrylate-dimethylaminoethyl methacrylate copolymer resin powder (copolymerization ratio; styrene:methyl methacrylate:dimethylaminoethyl methacrylate=75:10:15/average particle diameter 0.1 μm) was added to the toner L provided in Comparative Example 1, and the procedure of Example 10 was repeated to provide a toner S having a surface layer coated with a styrene-methyl methacrylate-dimethylaminoethyl methacrylate copolymer resin.

The toner S was combined with a Mn—Zn-based ferrite carrier coated with methyl methacrylate and subjected to measurement of the amount of charge. As a result, the amount of charge of the toner S under an environment of room temperature and ordinary humidity was 22 μC./g. Subsequently, the developer was exposed to an environment of 35° C. and 80% RH for 12 hr and stirred in the developing unit under the same environment for 3 min. As a result, the amount of charge recovered to about 90% of that under room temperature and ordinary humidity conditions by stirring for 3 min. Thus, it was confirmed that the sample had an excellent chargeability.

The above-described ferrite carrier coated with methyl methacrylate was combined with the toner S, mounted on an F6718K printer (manufactured by Fujitsu, Ltd.) to examine the printing properties. As a result, the sample exhibited excellent printing properties with respect to 100,000 sheets.

Comparative Example 5

The toner L provided in Comparative Example 1 was combined with a Mn—Zn-based ferrite carrier coated with methyl methacrylate and subjected to measurement of the amount of charge. As a result, the amount of charge of the toner L under an environment of room temperature and ordinary humidity was 12 μC./g. Subsequently, the developer was exposed to an environment of 35° C. and 80% RH for 12 hr and stirred in the developing unit under the same environment for 3 min. As a result, the amount of charge recovered to about 40% of that under room temperature and ordinary humidity conditions by stirring for 3 min. Thus, it was confirmed that the recovery of charge was difficult for this sample.

The above-described ferrite carrier coated with methyl methacrylate was combined with the toner L, mounted on an F6718K printer (manufactured by Fujitsu, Ltd.) to examine the printing properties. As a result, in a continuous running test under an environment of room temperature, the sample exhibited excellent printing properties with respect to 100,000 sheets. However, in resumption of printing after the printer was stopped for two days or more and in a continuous running test under high-temperature and high-humidity conditions, there occurred smudge or excessive development attributable to unsatisfactory recovery of charge, and no satisfactory printing property could be provided.

Comparative Example 6

A toner T containing an externally added resin was provided in the same manner as that of Example 8, except that a styrene-methyl methacrylate-dimethylaminoethyl methacrylate copolymer resin powder (copolymerization ratio; styrene:methyl methacrylate:dimethylaminoethyl methacrylate=75:10:15/average particle diameter 1.0 μm) was used as the fine powder of resin to be externally added.

The toner T was combined with a Mn—Zn-based ferrite carrier coated with methyl methacrylate and subjected to measurement of the amount of charge. As a result, the amount of charge of the toner S under an environment of room temperature and ordinary humidity was 22 μC./g. Subsequently, the developer was exposed to an environment of 35° C. and 80% RH for 12 hr and stirred in the developing unit under the same environment for 3 min. As a result, the amount of charge recovered to about 90% of that under room temperature and ordinary humidity conditions by stirring for 3 min. Thus, it was confirmed that the sample had an excellent chargeability.

The above-described ferrite carrier coated with methyl methacrylate was combined with the toner T, mounted on an F6718K printer (manufactured by Fujitsu, Ltd.) to examine the printing properties. As a result, the sample exhibited excellent printing properties with respect to about 20,000 sheets from the beginning of the printing. Thereafter, the amount of charge rapidly increased, and the print has become blurred.

The cause of this unfavorable phenomenon was investigated. As a result, it was found that the externally added resin powder was not sufficiently held on the surface of the toner and the use of the toner for a long period of time caused the resin powder to peel from the surface of the toner and accumulate in the developing unit.

Means (iii)

Example 12

A polyester resin comprising an ethylene oxide adduct of bisphenol A as a main diol monomer moiety and terephthalic acid as a main dicarboxylic acid monomer moiety was used as the binder resin. 1% of a quaternary ammonium salt was added thereto as a charge control agent, 2% of brominated phthalocyanine was added thereto as a coloring material, and 1% of polypropylene wax was added thereto as a fixation assistant. The mixture was melt-kneaded and pulverized to a particle diameter of 5 to 20 μm, thereby providing a base toner U.

Separately, a bisphenol A type epoxy resin was used as the binder resin, and 20% by weight of an aminium salt compound was added thereto. The mixture was melt-kneaded to provide a fine powder V of a resin containing an aminium salt compound and a particle diameter of 0.5 to 5 μm.

Subsequently, 3% by weight of a fine powder V of a resin containing an aminium salt compound was externally added to the base toner U with a supermixer to provide a toner W.

The toner W was combined with a ferrite carrier to provide a developer that was then mounted on an F6718K printer (manufactured by Fijitsu, Ltd.) and subjected to examination for flash fixability and chargeability under high-temperature and high-humidity conditions. As a result, the sample exhibited an excellent fixability of 75% in terms of the percentage fixation (tape peeling test). With respect to the chargeability, the developer was exposed to an environment of 35° C. and 80% RH for 12 hr and subjected to stirring in a developing unit in the same environment for 3 min. As a result, the amount of charge recovered to about 75% of that under room temperature and ordinary humidity conditions (this value being hereinafter referred to as "recovery of charge") by stirring for 3 min. Thus, it was confirmed that the sample had an excellent chargeability.

Example 13

A polyester resin comprising 1,3-butanediol as a main diol monomer moiety and terephthalic acid as a main dicarboxylic acid monomer moiety was used as the binder resin, and 20% by weight of an aminium salt compound was added thereto. The mixture was melt-kneaded to provide a fine powder X of a resin containing an aminium salt compound and a particle diameter of 0.5 to 5 μm.

Subsequently, 4% by weight of a fine powder X of a resin containing an aminium salt compound was externally added to the base toner U with a supermixer to provide a toner Y.

The toner Y was combined with a ferrite carrier to provide a developer that was then mounted on an F6718K printer (manufactured by Fijitsu, Ltd.) and subjected to examination for flash fixability and chargeability under high-temperature and high-humidity conditions. As a result, the sample exhibited an excellent fixability of 80% in terms of the percentage fixation (tape peeling test). With respect to the chargeability, the recovery of charge was about 85%. Thus, it was confirmed that the sample had an excellent chargeability.

Example 14

60% by weight of a bisphenol A type epoxy resin and 40% by weight of an aminium salt compound were dissolved in a methyl ethyl ketone solvent, and the solution was spray-dried with a spray dryer to provide a fine powder Z of a resin containing an aminium salt compound and a particle diameter of 0.5 to 2.0 μm.

Subsequently, 2% by weight of a fine powder Z of a resin containing an aminium salt compound was externally added to the base toner U with a supermixer to provide a toner α.

The toner α was combined with a ferrite carrier to provide a developer that was then mounted on an F6718K printer (manufactured by Fijitsu, Ltd.) and subjected to examination for flash fixability and chargeability under high-temperature and high-humidity conditions. As a result, the sample exhibited an excellent fixability of 90% ill terms of the percentage fixation (tape peeling test). With respect to the chargeability, the recovery of charge was about 90%. Thus, it was confirmed that the sample had an excellent chargeability.

Comparative Example 7

The base toner U provided in Example 12 was subjected to examination for fixability and chargeability in the same manner as of Example 12. As a result, although the recovery of charge was 80%, the toner exhibited no fixation, so that the results were unsatisfactory.

Comparative Example 8

The production of a fine powder of a resin containing an aminium salt compound and having a particle diameter of 0.5 to 5 μm was attempted by adding 20% by weight of an aminium salt compound to a polyester resin comprising an ethylene oxide adduct of bisphenol A as a main diol monomer moiety and terephthalic acid as a main dicarboxylic acid monomer moiety and melt-kneading the mixture. However, the particle diameter of the resultant powder (resin powder β to be externally added) was as large as 4 to 8 μm. 3% by weight of this resin powder was externally added to the base toner U with a supermixer to provide a toner γ. However, the externally added resin powder was not electrostatically deposited on the base toner U, and the externally added resin powder was scattered within the printer, which rendered this toner unsuitable for practical use.

Means (iv)

According to the finding of the present inventors, when an aminium salt compound is added and kneaded with a binder resin, if the binder resin is nonreactive with the aminium salt compound, the color tone of the kneaded product ranges from light yellowish green to light green that is the color tone of the aminium salt compound. On the other hand, if the binder resin is reactive with the aminium salt compound, the color tone of the kneaded product ranges from reddish brown to blackish brown.

By taking advantage of this phenomenon, the reactivity of the binder resin with the aminium salt compound was examined by adding, prior to the production of toners, melt-kneading an aminium salt compound with a mixture of a binder resin containing an acidic functional group with a resin for a positive chargeability and/or a positive charge control agent. The results are given in Table 2.

The resultant toners were combined with a Mn—Zn-based ferrite carrier coated with methyl methacrylate to provide developer that were then mounted on an F6718K printer (manufactured by Fijitsu, Ltd.) and subjected to examination of flash fixability and chargeability under high-temperature and high-humidity conditions. The results are given in Table 2. In Table 2, the fixability was evaluated based on the following criteria. ⊙: excellent fixability of 95% or more (tape peeling test) in terms of a percentage fixation; ○: percentage fixation of 90 to 80%; and X: percentage fixation of less than 80%. With respect to the chargeability under high-temperature and high-humidity conditions, the developer was exposed to an environment of 35° C. and 80% RH for 12 hr and subjected to stirring in a developing unit in the same environment for 3 min, and the chargeability was evaluated based on the following criteria. ⊙: percentage recovery of charge of 80% or more by stirring for 3 min based on the amount of charge under room temperature and ordinary humidity conditions; ○: percentage recovery of charge of 70 to 80%; and X: percentage recovery of charge of less than 70%.

Example 15

A polyester resin having an acid value of 48 mg/KOH was used as one binder resin in an amount of 80% of the total amount of the binder resin, and a styrene-dimethylaminoethyl methacrylate copolymer (styrene:dimethylaminoethyl methacrylate=66:34) was used as a binder resin for a positive chargeability in an amount of 20% by weight based on the total amount of the binder resin. 2% of brominated phthalocyanine (a coloring material) containing 2% of an aminium salt (an infrared light absorber) and 1% of polypropylene wax as a fixation assistant were added and melt-kneaded with the binder resin. The kneaded product was pulverized and classified to provide a toner δ.

Example 16

A sulfonic-acid-modified polyester resin having an acid value of 30 mg/KOH and comprising as indispensable constituent monomers terephthalic acid, an ethylene oxide adduct of bisphenol A and his (4-hydroxyphenyl)sulfonic acid, was used as one binder resin in an amount of 80% based on the total amount of the binder rein, and a styrene-dimethylaminoethyl methacrylate copolymer (styrene:dimethylaminoethyl methacrylate=66:34) was used as a binder resin for imparting a positive chargeability in an amount of 20% by weight based on the total amount of the binder resin. 2% of an aminium salt compound, 2% of brominated phthalocyanine (a coloring material) and 1% of polypropylene wax as a fixation assistant were added and melt-kneaded with the binder resin.. The kneaded product was pulverized and classified to provide a toner ϵ.

Example 17

A polyester resin having an acid value of 48 mg/KOH was used as one binder resin in an amount of 80% of the total amount of the binder resin, and a styrene-dimethylaminoethyl methacrylate copolymer (styrene:dimethylaminoethyl methacrylate=66:34) was used as a binder resin for a positive chargeability in an amount of 20% by weight based on the total amount of the binder resin. At the outset, both the resins were melt-kneaded with each other, and the kneaded product was pulverized to a particle diameter of about 1 mm to provide a resin melt-kneaded product. Subsequently, 2% of an aminium salt compound, 2% of brominated phthalocyanine (a coloring material) and 1% of polypropylene wax as a fixation assistant were added and melt-kneaded with the resin melt-kneaded product. The kneaded product was ζ. pulverized and classified to provide a toner

TABLE 2

| Toner | Binder resin | Reactivity with aminium salt (color) | Toner properties: Amount of charge | Toner properties: Recovery of charge | Toner properties: Fixability |
|---|---|---|---|---|---|
| δ Ex. 15 | Polyester (acid value: 48) Styrene-dimethylaminoethyl methacrylate | low (light green) | 14 μC/g | ○ | ○ |
| ε Ex. 16 | Polyester modified with sulfonic acid Styrene-dimethylaminoethyl methacrylate | low (light green) | 12 μC/g | ○ | ○ |
| ζ Ex. 17 | Polyester (acid value: 48) Styrene-dimethylaminoethyl methacrylate (resin pre-kneaded) | low (light green) | 15 μC/g | ○ | ⊙ |
| η Ex. 18 | Styrene-acrylic acid polyester (acid value: 15) in which styrene-dimethylaminomethyl methacrylate has been entrained | free (light green) | 14 μC/g | ⊙ | ⊙ |
| θ Comp. EX. 9 | Polyester (acid value: 3) Styrene-dimethylaminoethyl methacrylate | high (brown) | 16 μC/g | X | X |

Example 18

Submicron particles of a styrene-dimethylaminoethyl methacrylate copolymer (styrene:dimethylaminoethyl methacrylate=66:34) were prepared as a binder resin for a positive chargeability. The binder resin introduced during polymerization of a styrene-acrylic acid copolymer having an acid value of 25 mg/KOH to provide a styrene-acrylic acid copolymer in which styrene-dimethylaminoethyl methacrylate copolymer particles had been encapsulated. The weight ratio of the styrene-dimethylaminoethyl methacrylate copolymer to the styrene-acrylic acid copolymer was 50:50. The styrene-acrylic acid copolymer in which styrene-dimethylaminoethyl methacrylate copolymer particles had been encapsulated was used in an amount of 80% based on the total amount of the binder resin, and a polyester resin having an acid value of 15 mg/KOH and comprising as main constituent monomers 1,3-propanediol and terephthalic acid was used in an amount of 20% based on the total amount of the binder resin. 2% of an aminium salt compound, 2% of brominated phthalocyanine (a coloring material) and 1% of polypropylene wax as a fixation assistant were melt-kneaded with the binder resin. The kneaded product was pulverized and classified to provide a toner η.

Comparative Example 9

A polyester resin having an acid value of 3 mg/KOH was used as one binder resin in an amount of 70% of the total amount of the binder resin, and a styrene-dimethylaminoethyl methacrylate copolymer (styrene:dimethylaminoethyl methacrylate=66:34) was used as a binder resin for a positive chargeability in an amount of 30% by weight based on the total amount of the binder resin. 2% of an aminium salt compound, 2% of brominated phthalocyanine (a coloring material) and 1% of polypropylene wax as a fixation assistant were added and melt-kneaded with the binder resin. The kneaded product was pulverized and classified to provide a toner θ.

Means (v)

The reactivity of the binder resin with the aminium salt compound and properties of the produced toners were evaluated in the same manner as that described above in examples in connection with the means (iv). The results are given in Table 3.

Example 19

A styrene-vinylpyrrolidone copolymer (styrene:vinylpyrrolidone=80:20) was used as a binder resin having a positive chargeability in an amount of 50% by weight based on the total amount of the binder resin, and a polyester resin comprising as main constituent monomers terephthalic acid and a bisphenol A ethylene oxide adduct was used in an amount of 50% by weight based on the total amount of the binder resin. 2% of an aminium salt compound, 2% of brominated phthalocyanine (a coloring material) and 1% of polypropylene wax as a fixation assistant were added and melt-kneaded with the binder resin. The kneaded product was pulverized and classified to provide a toner 1.

Example 20

A methyl methacrylate-vinylpyrimidine copolymer (methyl methacrylate:vinylpyrimidine=85:15) was used as a binder resin having a positive chargeability in an amount of 30% by weight based on the total amount of the binder resin, and a polyester resin comprising as main constituent monomers terephthalic acid and a bisphenol A ethylene oxide adduct was used in an amount of 70% by weight based on the total amount of the binder resin. 2% of an aminium salt compound, 2% of brominated phthalocyanine (a coloring material) and 1% of polypropylene wax as a fixation assistant were added and melt-kneaded with the binder resin. The kneaded product was pulverized and classified to provide a toner κ.

Example 21

A methyl methacrylate-dimethylacrylamide copolymer (methyl methacrylate:dimethylacrylamide=80:20) was used as a binder resin having a positive chargeability in an amount of 40% by weight based on the total amount of the binder resin, and a polyester resin comprising as main constituent monomers terephthalic acid and a bisphenol A ethylene oxide adduct was used in an amount of 60% by weight based on the total amount of the binder resin. 2% of an aminium salt compound, 2% of brominated phthalocyanine (a coloring material) and 1% of polypropylene wax as a fixation assistant were added and melt-kneaded with the binder resin. The kneaded product was pulverized and classified to provide a toner λ.

Example 22

An amide-modified polyester (amine monomer: 15% by mole) prepared by reacting an amine with a carboxylic acid of a polyester was used as a binder resin having a positive chargeability. 2% of an aminium salt compound, 2% of brominated phthalocyanine (a coloring material) and 1% of polypropylene wax as a fixation assistant were added and melt-kneaded with the binder resin. The kneaded product was pulverized and classified to provide a toner μ.

Example 23

A urethane-modified polyester (with 30% of the terminal OH group blocked with urethane) prepared by reacting an isocyanate with a hydroxyl group of a polyester resin comprising indispensable constituent monomers terephthalic acid and a bisphenol A ethylene oxide adduct was used as a binder resin having a positive chargeability. 2% of an aminium salt compound, 2% of brominated phthalocyanine (a coloring material) and 1% of polypropylene wax as a fixation assistant were added and melt-kneaded with the binder resin. The kneaded product was pulverized and classified to provide a toner ν.

Example 24

An amine-crosslinked epoxy resin prepared by crosslinking bisphenol A epoxy with N-aminoethylpiperazine was used as a binder resin having a positive charge in an amount of 30% by weight based on the total amount of the binder resin, and a polyester resin comprising as main constituent monomers terephthalic acid and a bisphenol A ethylene oxide adduct was used in an amount of 70% by weight based on the total amount of the binder resin. 2% of an aminium salt compound, 2% off brominated phthalocyanine (a coloring material) and 1% of polypropylene wax as a fixation assistant were added and melt-kneaded with the binder resin. The kneaded product was pulverized and classified to provide a toner ξ.

Example 25

Propylenebishydroxyarachic amide was used as a binder resin having a positive chargeability in an amount of 20% by weight based on the total amount of the binder resin, and a polyester resin comprising as main constituent monomers terephthalic acid and a bisphenol A ethylene oxide adduct was used in an amount of 80% by weight based on the total amount of the binder resin. 2% of an aminium salt compound, 2% of brominated phthalocyanine (a coloring material) and 1% of polypropylene wax as a fixation assistant were added and melt-kneaded with the binder resin. The kneaded product was pulverized and classified to provide a toner π.

Comparative Example 10

A styrene-2-ethylhexyl acrylate copolymer (styrene:2-ethylhexyl acrylate=75:25) was used as one binder resin in an amount of 50% by weight based on the total amount of the binder resin, and a polyester resin comprising as main constituent monomers terephthalic acid and a bisphenol A ethylene oxide adduct was used as another binder resin in an amount of 50% by weight based on the total amount of the binder resin. 2% of an aminium salt compound, 2% of brominated phthalocyanine (a coloring material) and 1% of polypropylene wax as a fixation assistant were added and melt-kneaded with the binder resin. The kneaded product was pulverized and classified to provide a toner ρ.

Comparative Example 11

A toner σ was provided in the same manner as that of Examples 19 to 21, except that 20% by weight, based on the total amount of the binder resin, of a styrene-dimethylaminoethyl methacrylate copolymer (styrene:dimethylaminoethyl methacrylate=90:10) was used as an alternative to the binders having a positive chargeability described in Examples 19 to 21.

Comparative Example 12

A toner τ was provided in the same manner as that of Examples 19 to 21, except that 20% by weight, based on the total amount of the binder resin, of a styrene-methyl methacrylate-dimethylacrylamide copolymer (styrene:methyl methacrylate:dimethylacrylamide=35:30:35) was used as an alternative to the binders having a positive chargeability described in Examples 19 to 21.

Comparative Example 13

A toner ν was provided in the same manner as that of Examples 19 to 21, except that 2% by weight of a quaternary ammonium salt charge control agent (P-51 manufactured by Orient Chemical Industries, Ltd.) was used and use was made of none of the binders having a positive chargeability described in Examples 19 to 21.

The results of evaluation are summarized in Table 3. As is apparent from Table 3, when a positive chargeability was imparted to the toner using as the binder a resin comprising dimethylaminoethyl methacrylate as a constituent monomer or when a positive chargeability was imparted to the toner using a quaternary ammonium salt charge control agent, the aminium salt was influenced by the above charge control agent and binder, which gave rise to a remarkable lowering in the fixability.

On the other hand, in toners using no positive charge control agent or toners using no binder having capability of imparting a positive charge, the recovery of charge in re-stirring after standing was poor, and these binders had too many problems to put them to practical use.

In order to simultaneously solve the above-described problems, it is necessary to use thermoplastic resins which can take nitrogen-containing cyclic structures, such as an imidazole ring, a pyrimidine ring, a pyrrolidone ring, a pyrazole ring, a pyrroline ring and a pyrrole ring, and/or take structures wherein an amide group represented by the formula —$RCONH_2$ (wherein R represents a benzene ring or an aliphatic hydrocarbon having 0 to 2 carbon atoms) is coordinated. in a pendant form to the molecular chain of the binder, particular polyester or epoxy, amide resins, etc. described herein.

TABLE 3

| Toner | Binder resin | Reactivity with aminium salt (color) | Toner idroperties: Amount of charge | Fixability | Recovery of charge |
|---|---|---|---|---|---|
| ι Ex. 19 | Styrene-vinylpyrrolidone copolymer<br>Polyester | low (light green)<br>free (light green) | 16 μC/g | ○ | ◎ |
| κ Ex. 20 | methyl methacrylate-vinyl-pyrimidine<br>Polyester | low (light green)<br>free (light green) | 18 μC/g | ◎ | ○ |
| λ Ex. 21 | Methyl methacrylate-dimethylacrylamide<br>Polyester | low (light green)<br>free (light green) | 18 μC/g | ◎ | ◎ |
| μ Ex. 22 | Amine-modified polyester | low (light green) | 15 μC/g | ○ | ○ |
| ν Ex. 23 | Urethane-modified polyester | free (light green) | 14 μC/g | ○ | ○ |
| ξ Ex. 24 | Amine-crosslinked epoxy<br>Polyester | low (light green)<br>free (light green | 16 μC/g | ◎ | ○ |
| π Ex. 25 | Propylenebishydroxyarachic amide<br>Polyester | free (light green)<br>free (light green) | 14 μC/g | ◎ | ○ |
| ρ Comp. Ex. 9 | Styrene-2-ethylhexyl acrylate<br>Polyester | medium (dark green)<br>free (light green) | 12 μC/g | ○ | X |
| C Comp. Ex. 1 | Polyester | free (light green) | 10 μC/g | ◎ | X |
| σ Comp. Ex. 11 | Styrene-dimethylaminoethyl methacrylate<br>Polyester | high (brown)<br>free (light green) | 16 μC/g | X | X |
| τ Comp. Ex. 12 | Styrene-methyl methacrylate-dimethylacrylamide<br>Polyester | medium (dark green)<br>free (light green) | 14 μC/g | X | ○ |
| υ Comp. Ex. 13 | Polyester<br>Quaternary ammonium salt (charge control agent) | free (light green)<br>high (brown) | 18 μC/g | X | X |

Means (vi)

Example 26

A polyester resin comprising a bisphenol A ethylene oxide adduct as a main diol monomer moiety and terephthalic acid as a main dicarboxylic a acid monomer moiety was used as a binder resin. 2% of an aminium salt compound having a hexafluoroantimonate ion as an anion, 1% of a quaternary ammonium salt having the same anion, 2% of brominated phthalocyanine as a coloring material and 1% of polypropylene wax as a fixation assistant were added and melt-kneaded with the binder resin. The kneaded product was pulverized and classified to provide a toner ϕ.

The toner ϕ was combined with a ferrite carrier to provide a developer that was then mounted on a printer F6718K (manufactured by Fijitsu, Ltd.) and subjected to examination for flash fixability (fusibility) and chargeability under high-temperature and high-humidity conditions. As a result, the sample exhibited an excellent fixability of 85% in terms of the percentage fixation (tape peeling test).

With respect to the chargeability, the developer was exposed to an environment of 35° C. and 80% RH for 12 hr and subjected to stirring in a developing unit in the same environment for 3 min. As a result, the amount of charge recovered to about 80% of that under room temperature and ordinary humidity conditions after stirring for 3 min. Thus, it was confirmed that the sample had an excellent electrificability.

Example 27

Use was made of the same binder resin as that used in Example 26, and 3% of an aminium salt compound having a perchlorate ion as a common anion, 1% of a quaternary ammonium salt, 0.2% of a molybdate quaternary ammonium salt, 2% of brominated phthalocyanine and 1% of polypropylene wax were added and melt-kneaded with the binder resin. The kneaded product was pulverized and classified to provide a toner χ.

The toner χ was subjected to examination for fixability and chargeability in the same manner that of Example 26. As a result, it exhibited excellent properties, i.e., a fixation of 90% and a recovery of charge of 90%.

Means (vii)

Example 28

A polyester resin comprising a bisphenol A ethylene oxide adduct as a main diol monomer moiety and terephthalic acid as a main dicarboxylic acid monomer moiety was used as a binder resin. 1.5% by weight of a compound represented by the structural formula (1) and having a perchlorate ion as an anion, 0.5% by weight of a compound represented by the structural formula (2) having a perchlorate ion as an anion, 2.5% by weight of a quinacridone red pigment as a coloring material and 1% of polypropylene wax as a fixation assistant were added to the binder resin. The mixture was melt-kneaded, pulverized and classified to provide a toner ϕ with a red tone having a high chroma.

The toner ϕ was combined with a ferrite carrier to provide a developer that was then mounted on a printer F6718K (manufactured by Fijitsu, Ltd.) and subjected to examination for flash fixability and chargeability under high-temperature and high-humidity conditions. As a result, the sample exhibited an excellent fixability of 85% in terms of the percentage fixation (tape peeling test). With respect to the chargeability, the developer was exposed to an environment of 35° C. and 80% RH for 12 hr and subjected to stirring in a developing unit in the same environment for 3 min. As a result, the amount of charge recovered to about 80% of that under room temperature and ordinary humidity conditions after stirring for 3 min. Thus, it was confirmed that the sample had an excellent chargeability.

Example 29

A polyester resin comprising a bisphenol A ethylene oxide adduct as a main diol monomer moiety and terephthalic acid as a main dicarboxylic monomer acid moiety was used as a binder resin. 2.0% by weight of a compound represented by the structural formula (1) and having a perchlorate ion as an anion, 0.5% by weight of a compound represented by the structural formula (1) having a hexafluoroantimonate ion as an anion, 2.5% by weight of a quinacridone red pigment as a coloring material and 1% of polypropylene wax as a fixation assistant were added to the binder resin. The mixture was melt-kneaded, pulverized and classified to provide a toner ω with a red tone having a high chroma.

The toner ω was combined with a ferrite carrier to provide a developer that was then mounted on a printer F6718K (manufactured by Fijitsu, Ltd.) and subjected to examination for flash fixability and chargeability under high-temperature and high-humidity conditions. As a result, the sample exhibited an excellent fixability of 85% in terms of the percentage fixation (tape peeling test). With respect to the chargeability, the recovery of charge was about 80%. Thus, it was confirmed that the sample had an excellent chargeability.

Comparative Example 14

A polyester resin comprising a bisphenol A ethylene oxide adduct as a main diol monomer moiety and terephthalic acid as a main dicarboxylic acid monomer moiety was used as a binder resin. 1.5% by weight of a compound represented by the structural formula (1) and having a perchlorate ion as an anion, 2.5% by weight of a quinacridone red pigment as a coloring material and 1% of polypropylene wax as a fixation assistant were added to the binder resin. The mixture was melt-kneaded, pulverized and classified to provide a toner a with a red tone having a high chroma.

The toner a was combined with a ferrite carrier to provide a developer that was then mounted on a printer F6718K (manufactured by Fijitsu, Ltd.) and subjected to examination for flash fixability and chargeability under high-temperature and high-humidity conditions. As a result, the sample exhibited an excellent fixability of 85% in terms of the percentage fixation (tape peeling test). With respect to the chargeability, however, the recovery of charge was as low as about 50%. Thus, it was found that the sample had an chargeability problem.

Comparative Example 15

A polyester resin comprising a bisphenol A ethylene oxide adduct as a main diol monomer moiety and terephthalic acid as a main dicarboxylic acid monomer moiety was used as a binder resin. 2.0% by weight of a compound represented by the structural formula (2) and having a perchlorate ion as an anion, 2.5% by weight of a quinacridone red pigment as a coloring material and 1% of polypropylene wax as a fixation assistant were added to the binder resin. The mixture was melt-kneaded, pulverized and classified to provide a toner b. The color tone of the toner b was reddish brown and unfavorable as a red toner due to a lowering in the color quality.

Means (viii)

Example 30

A polyester resin comprising a bisphenol A ethylene oxide adduct as a main diol monomer moiety and terephthalic acid as a main dicarboxylic acid monomer moiety was used as a binder resin. 0.5% by weight of a quaternary ammonium salt having a molybdate ion as an anion (a charge control agent), 2.5% by weight of a quinacridone red pigment as a coloring material and 1% of polypropylene wax as a fixation assistant, 1.5% by weight of an aminium salt compound having a perchlorate ion as an anion (a first infrared light absorber) and 0.5% by weight of bis(1,2-dithiophenolate)nickel-tetra-n-butyl ammonium salt (a second infrared light absorber) were added to the binder resin. The mixture was melt-kneaded, pulverized and classified to provide a toner d.

The toner d was combined with a ferrite carrier to provide a developer that was then mounted on a printer F6718K (manufactured by Fijitsu, Ltd.) and subjected to examination for flash fixability and chargeability under high-temperature and high-humidity conditions. As a result, the sample exhibited an excellent fixability of 85% in terms of the percentage fixation (tape peeling test). With respect to the chargeability, the developer was exposed to an environment of 35° C. and 80% RH for 12 hr and subjected to stirring in a developing unit in the same environment for 3 min. As a result, the amount of charge recovered to about 80% of that under room temperature and ordinary humidity conditions after stirring for 3 min. Thus, it was confirmed that the sample had an excellent chargeability.

Example 31

A toner e was provided in the same manner as that of Example 30, except that 1.0% by weight of bis(1-mercaptolate-2-naphtholate)platinum-tetra-n-butyl ammonium salt was used as the second infrared light absorber. The toner e was combined with a ferrite carrier to provide a developer that was then mounted on a printer F6718K (manufactured by Fijitsu, Ltd.) and subjected to examination for flash fixability and chargeability under high-temperature and high-humidity conditions. As a result, the sample exhibited an excellent fixability of 90% in terms of the percentage fixation (tape peeling test). With respect to the chargeability, the recovery of charge was about 75%. Thus, it was confirmed that the sample had an excellent chargeability.

Example 32

A toner f was provided in the same manner as that of Example 30, except that 0.5% by weight of bithienylidenebisbenzoquinone was used as the second infrared light absorber. The toner F was combined with a ferrite carrier to provide a developer that was then mounted on a printer F6718K (manufactured by Fijitsu, Ltd.) and subjected to examination for flash fixability and chargeability under high-temperature and high-humidity conditions. As a result, the sample exhibited an excellent fixability of 90% in terms of the percentage fixation (tape peeling test). With respect to the chargeability, the recovery of charge was 85%. Thus, it was confirmed that the sample had an excellent chargeability.

Example 33

A toner g was provided in the same manner as that of Example 30, except that 0.3% by weight of vanadyloxy-hexadecamethylphthalocyanine was used as the second infrared light absorber. The toner g was combined with a ferrite carrier to provide a developer that was then mounted on a printer F6718K (manufactured by Fijitsu, Ltd.) and subjected to examination for flash fixability and chargeability under high-temperature and high-humidity conditions. As a result, the sample exhibited an excellent fixability of 90% in terms of the percentage fixation (tape peeling test). With respect to the chargeability, the recovery of charge was 85%. Thus, it was confirmed that the sample had an excellent chargeability.

Example 34

A toner C was provided in the same manner as that of Example 1. 0.8% of a powder of propylenebishydroxyarachic amide (average particle diameter: 1.5 μm) was externally added to the toner C with a henschel mixer to provide a toner h. The fixability and chargeability of the toner h were examined in the same manner as that of Example 1 and found to be 95% in terms of percentage fixation and 90% in terms of percentage recovery of charge, respectively. Thus, it was confirmed that the external addition of the hydroxyamide compound contributed to a further improvement in toner properties.

Example 35

A polyester resin (melting temperature: 135° C.) comprising a bisphenol A ethylene oxide adduct as a main diol monomer moiety and terephthalic acid as a main dicarboxylic acid monomer moiety was used as a binder resin, and a nigrosine dye and carbon were added to the binder resin. The mixture was melt-kneaded and subjected to jet milling to an average particle diameter of about 10 μm to provide a base toner j. 0.5% of a powder of propylenebishydroxy-arachic amide (average particle diameter: 1.5 μm) was externally added to the base toner j with a henschel mixer to provide a toner l.

The toner l was combined with a ferrite carrier to provide a developer that was then mounted on a printer F6700 (manufactured by Fijitsu, Ltd.) and subjected to examination for toner flash fixability, blocking resistance, film formation of the toner on a photoconductor drum and a change in printing properties in a long-term running test.

As a result, the toner caused no blocking even when it was allowed to stand in an environment of 60° C. for 24 hr. Further, it exhibited an excellent fixability of 90% in terms of the percentage fixation (tape peeling test). Further, the formation of a toner film on the photoconductor drum did not occur even after continuous printing of 1,000,000 sheets, and excellent printing properties were maintained for a long period of time.

Example 36

1.0% by weight of an amide oligomer powder (weight average molecular weight: 2000, average particle diameter: 1 μm) comprising indispensable constituent monomers malic acid and methylenediamine, was externally added to the same base toner j as that of Example 34 with a henschel mixer to provide a toner m.

The toner m was combined with a ferrite carrier to provide a developer that was then mounted on a printer F6700 (manufactured by Fijitsu, Ltd.) and subjected to examination for toner flash fixability, blocking resistance, film formation of the toner on a photoconductor drum and a change in printing properties in a long-term running test.

As a result, the toner caused no blocking even when it was allowed to stand in an environment of 60° C. for 24 hr. Further, it exhibited an excellent fixability of 85% in terms of the percentage fixation (tape peeling test). Further, the formation of a toner film on the photoconductor drum did not occur even after continuous printing of 1,000,000 sheets, and excellent printing properties were maintained for a long period of time.

REFERENCE EXAMPLE

Toner flash fixability, blocking resistance, film formation of the toner on a photoconductor drum and a change in printing properties in a long-term running test were examined in the same manner as that of Example 34, except that the powder of propylenebishydroxyarachic amide was not externally added.

As a result, although the toner caused no blocking even when it was allowed to stand in an environment of 60° C. for 24 hr, the flash fixability was as low as 60% in terms of the percentage fixation (tape peeling test).

As is apparent from the foregoing description, according to the present invention, in a flash fixing color toner, an aminium salt infrared absorber having a high capability of absorbing infrared light and a light color (which means noninterfering with the tone of a coloring material) in a visible light region is used in combination with a positive charge control agent which generally reacts with the aminium salt infrared light absorber to lower the light absorption capability of the aminium salt infrared light absorber. Since, however, the constitution of the present invention is such that the reaction between the infrared light absorber and the positive charge control agent is physically or chemically prevented, suppressed or compensated for, the present invention has the effect of bringing all of the tone, chargeability and flash fixability (fusibility) of the flash fixing color toner to satisfactory levels.

We claim:

1. A process for producing a flash fusing color toner comprising the steps of:

providing a first binder resin containing, in a dispersed or melted state, an aminium salt compound represented by at least one compound of the general formula (1) and general formula (2):

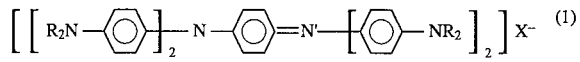

(1)

wherein $X^-$ is an arbitrary anion with an arbitrary valency, and

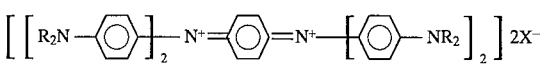

(2)

wherein $X^-$ is an arbitrary anion with an arbitrary valency, and a second binder resin different from said first binder resin and containing, in a dispersed or melted state, a positive charge control agent, said binder resin having a solubility parameter different from a solubility parameter of said first binder resin by at least 0.5, kneading said first and second binder resins with each other to form a mixture of said first and second binder resins in which said first and second binder resins exist as separate phases, said aminium salt compound is essentially contained in the phase of said first binder resin, and said positive charge control agent is essentially contained in the phase of said second binder resin, and pulverizing said mixture to form toner particles having the structure of said mixture.

2. A process producing a flash fixing color toner comprising the steps of: aggregating and binding in liquid phase several tens to several tens of thousands of particles of a first fine powder of a first binder resin containing, in a dispersed or melted state, an ammonium salt compound represented by at least one compound of the general formula (1) and general formula (2):

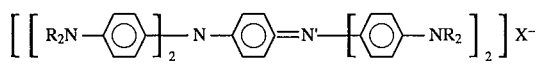

(1)

wherein $X^-$ is an arbitrary anion with an arbitrary valency, and

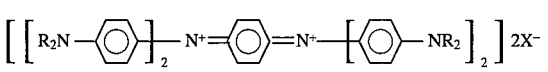

(2)

wherein $X^-$ is an arbitrary anion with an arbitrary valency, and a second fine powder of a second binder resin containing, in a dispersed or melted state, at least one positive charge control agent selected from the group consisting of a positive charge control resin, an amine-functional-group-containing resin having a functional group of a secondary amine, a tertiary amine, a quaternary amine and a quaternary ammonium salt, to form a toner in which said particles of said first and second powders are aggregated and bound to each other, said first and second binder resins existing as separate phases, said ammonium salt-compound being contained essentially in said first binder resin phase, said positive charge control agent being contained essentially in said second binder resin phase.

3. The process according to claim 2, wherein several tens to several tens of thousands of particles of said first fine powder and said second fine powder, together with a third fine powder of a thermoplastic resin having a lower melting temperature than said first and second fine powders, are aggregated and the liquid phase is heated at a temperature which does not melt said first and second fine powders but melts said third fine powder to bind the fine powders with one another.

* * * * *